US010934738B2

(12) United States Patent
Carter

(10) Patent No.: US 10,934,738 B2
(45) **Date of Patent: *Mar. 2, 2021**

(54) PORTABLE CONTAINMENT ROOM

(71) Applicant: INTERNATIONAL E-Z UP, INC., Norco, CA (US)

(72) Inventor: Mark C. Carter, Norco, CA (US)

(73) Assignee: INTERNATIONAL E-Z UP, INC., Norco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/702,402

(22) Filed: Dec. 3, 2019

(65) Prior Publication Data

US 2020/0102766 A1 Apr. 2, 2020

Related U.S. Application Data

(63) Continuation-in-part of application No. 16/670,937, filed on Oct. 31, 2019, which is a continuation-in-part of application No. 16/397,982, filed on Apr. 29, 2019.

(60) Provisional application No. 62/774,804, filed on Dec. 3, 2018, provisional application No. 62/754,822, filed on Nov. 2, 2018, provisional application No. 62/664,855, filed on Apr. 30, 2018.

(51) Int. Cl.

| | |
|---|---|
| ***E04H 15/14*** | (2006.01) |
| ***E04H 15/16*** | (2006.01) |
| ***E04H 15/50*** | (2006.01) |
| ***E04H 15/56*** | (2006.01) |
| *E04H 15/64* | (2006.01) |
| *E04H 1/12* | (2006.01) |

(52) U.S. Cl.

CPC ..... *E04H 15/14* (2013.01); *E04H 15/16* (2013.01); *E04H 15/50* (2013.01); *E04H 15/56* (2013.01); *E04H 1/1244* (2013.01); *E04H 1/1266* (2013.01); *E04H 15/64* (2013.01)

(58) Field of Classification Search

CPC ..... E04H 15/14; E04H 15/16; E04H 1/1266

See application file for complete search history.

(56) References Cited

U.S. PATENT DOCUMENTS

| | | | | |
|---|---|---|---|---|
| 3,148,688 A * | 9/1964 | Arnopole | E04H 15/14 | 135/117 |
| 3,505,989 A * | 4/1970 | Truhan | A61G 13/108 | 600/21 |
| 4,804,392 A * | 2/1989 | Spengler | B01L 1/04 | 454/187 |
| 5,645,480 A * | 7/1997 | Spengler | F24F 3/161 | 454/187 |
| 5,725,426 A * | 3/1998 | Alvarez | A61G 13/108 | 135/90 |
| 6,341,579 B1 * | 1/2002 | Alkire | A01K 1/0107 | 119/165 |

(Continued)

*Primary Examiner* — David R Dunn
*Assistant Examiner* — Danielle Jackson
(74) *Attorney, Agent, or Firm* — Seyfarth Shaw LLP; Puya Partow-Navid

(57) ABSTRACT

A containment room is presented. The containment room includes multiple opaque sides. One of the opaque sides includes an opening for providing access to an interior of the containment room. The containment room includes a roof attached to the opaque sides. The containment room also includes pockets integrated with the roof, each pocket receives an insert.

16 Claims, 23 Drawing Sheets

(56) References Cited

U.S. PATENT DOCUMENTS

| | | | | |
|---|---|---|---|---|
| 6,508,850 | B1 * | 1/2003 | Kotliar | A61G 10/005 55/385.2 |
| 6,742,309 | B2 * | 6/2004 | Stewart | A47K 3/286 135/94 |
| 7,134,444 | B2 * | 11/2006 | Mintie | B08B 15/00 135/131 |
| 7,406,978 | B2 * | 8/2008 | Mintie | B08B 15/00 135/131 |
| 9,534,407 | B2 * | 1/2017 | Ballantyne | A61G 10/005 |
| 9,565,830 | B1 * | 2/2017 | Caico | A01K 1/0047 |
| 10,138,653 | B1 * | 11/2018 | Weber | E04H 15/54 |
| 10,219,961 | B2 * | 3/2019 | Patel | E04H 3/08 |
| 2004/0071587 | A1 * | 4/2004 | McAtarian | A61L 2/26 422/1 |
| 2004/0074212 | A1 * | 4/2004 | Yachi | A61G 10/005 55/385.2 |
| 2005/0189010 | A1 * | 9/2005 | Sumner | E04H 15/56 135/137 |
| 2006/0213546 | A1 * | 9/2006 | Mitsui | E04H 15/42 135/121 |
| 2006/0254158 | A1 * | 11/2006 | Saller | E04H 15/04 52/63 |
| 2011/0297096 | A1 * | 12/2011 | Northrop | A01K 1/0107 119/165 |
| 2012/0325279 | A1 * | 12/2012 | Munoz | B08B 15/026 135/93 |
| 2019/0150628 | A1 * | 5/2019 | Wennerstrom | B03C 3/12 |

* cited by examiner

PORTABLE CONTAINMENT ROOM

CROSS-REFERENCE TO RELATED APPLICATION

This application claims the benefit of U.S. Provisional Patent Application No. 62/774,804, filed on Dec. 3, 2018, entitled "PORTABLE CONTAINMENT ROOM," and is also a continuation-in-part of U.S. application Ser. No. 16/670,937, filed on Oct. 31, 2019, entitled "PORTABLE ROOM WITH CEILING POCKETS," which claims the benefit of U.S. Provisional Patent Application No. 62/754,822, filed on Nov. 2, 2018, entitled "PORTABLE ROOM WITH CEILING POCKETS," and is a continuation-in-part of U.S. application Ser. No. 16/397,982, filed on Apr. 29, 2019, entitled "PORTABLE ROOM," which claims the benefit of U.S. Provisional Patent Application No. 62/664,855, entitled "PORTABLE ROOM," filed on Apr. 30, 2018, the disclosures of which are expressly incorporated by reference herein in their entirety.

BACKGROUND

Field

Certain aspects of the present disclosure generally relate to folding, collapsible structures.

Background

Portable rooms, such as tents or screened rooms, can be transported and assembled at various locations for various purposes. For example, a tent may be used for camping. As another example, a screened room may be used to shelter occupants while providing a view of a surrounding environment. In yet another example, a room may be erected for a crime scene investigation, medical treatment, and/or as a clean area.

Conventional portable rooms include fabric that is erected with poles, ropes, and stakes. For ease of transportation, conventional portable rooms use light-weight fabrics. In some cases, portable rooms are used for camping and outdoor activities. It is desirable to improve portable rooms such that they may be used for other tasks, such as painting, or other industrial tasks. When using the portable room for industrial tasks, as well as conventional tasks (e.g., camping), it may be desirable to integrate pockets in the ceiling. The pockets may be used to receive filters for a filtration system. The pockets may also be used to receive other material, such as a transparent material to provide a sunroof.

SUMMARY

In one aspect of the present disclosure, a containment room is disclosed. The containment room includes multiple opaque sides. One of the opaque sides includes an opening for providing access to an interior of the containment room. The containment room also includes a roof attached to the opaque sides. The containment room further includes pockets integrated with the roof. Each pocket is configured to receive an insert.

Another aspect of the present disclosure is directed to a containment room in combination with a frame. The frame includes multiple legs for supporting a roof structure comprising an inner truss and an outer truss. The containment room includes multiple opaque sides. One of the opaque sides includes an opening for providing access to an interior of the containment room. Additionally, one or more opaque sides are attached to one or more of the legs. The containment room also includes a roof attached to the opaque sides. The containment room further includes pockets integrated with the roof. Each pocket is configured to receive an insert.

In another aspect of the present disclosure, a portable room is disclosed. The portable room includes multiple sides. The portable room also includes a roof attached to the multiple sides. The portable room further includes multiple pockets integrated with the roof. Each pocket receiving an insert.

The features, nature, and advantages of the present disclosure will become more apparent from the detailed description set forth below when taken in conjunction with the drawings in which like reference characters identify correspondingly throughout.

DETAILED DESCRIPTION

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. However, it will be apparent to those skilled in the art that these concepts may be practiced without these specific details. In some instances, well-known structures and components are shown in block diagram form in order to avoid obscuring such concepts.

Based on the teachings, one skilled in the art should appreciate that the scope of the disclosure is intended to cover any aspect of the disclosure, whether implemented independently of or combined with any other aspect of the disclosure. For example, an apparatus may be implemented or a method may be practiced using any number of the aspects set forth. In addition, the scope of the disclosure is intended to cover such an apparatus or method practiced using other structure, functionality, or structure and functionality in addition to or other than the various aspects of the disclosure set forth. It should be understood that any aspect of the disclosure disclosed may be embodied by one or more elements of a claim.

The word "exemplary" is used herein to mean "serving as an example, instance, or illustration." Any aspect described herein as "exemplary" is not necessarily to be construed as preferred or advantageous over other aspects.

Although particular aspects are described herein, many variations and permutations of these aspects fall within the scope of the disclosure. Although some benefits and advantages of the preferred aspects are mentioned, the scope of the disclosure is not intended to be limited to particular benefits, uses or objectives. Rather, aspects of the disclosure are intended to be broadly applicable to different technologies, system configurations, networks and protocols, some of which are illustrated by way of example in the figures and in the following description of the preferred aspects. The detailed description and drawings are merely illustrative of the disclosure rather than limiting, the scope of the disclosure being defined by the appended claims and equivalents thereof.

Figure 1A:
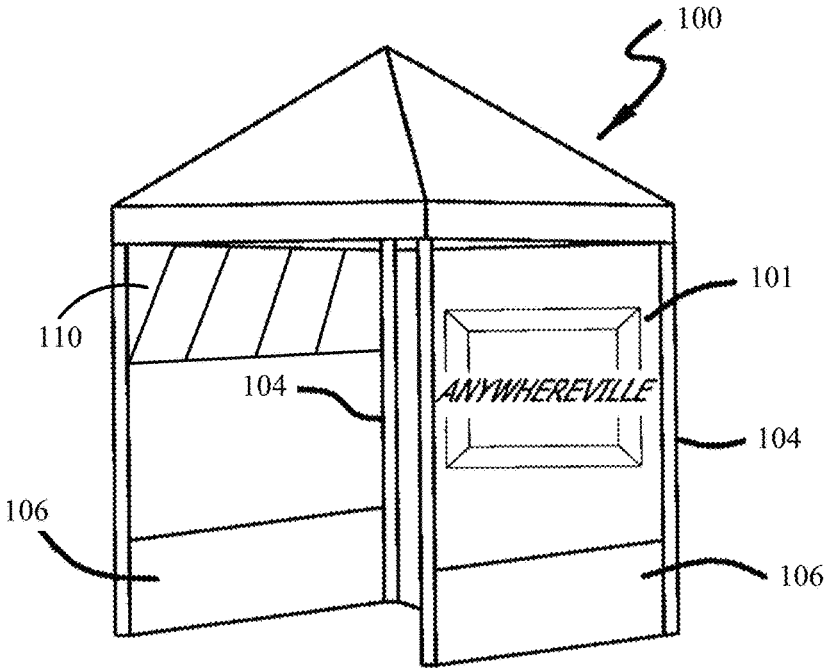
FIG. 1A (Prior Art)
FIGS. 1A and 1B illustrate examples of shelters with various structures attached to the frames.
Figure 1B:
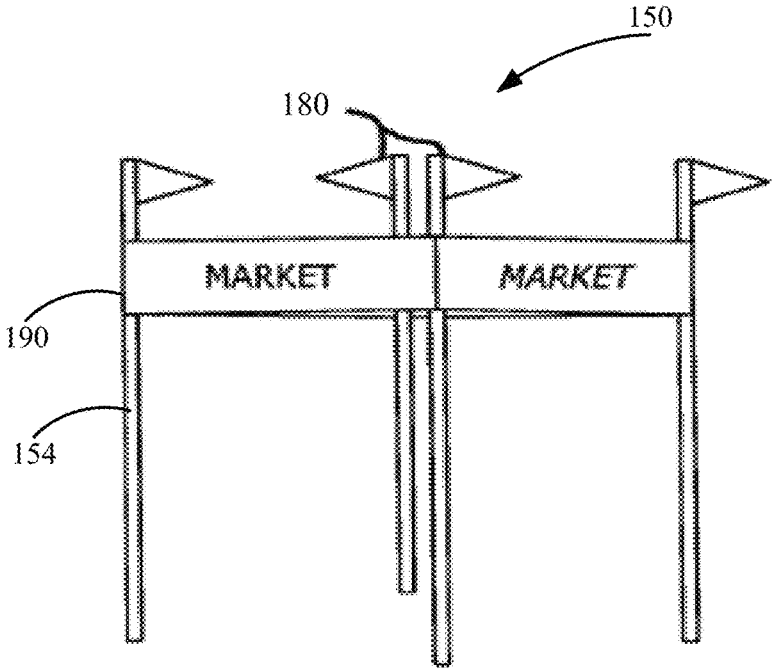
FIG. 1B (Prior Art)

FIG. 1A illustrates an example of a conventional shelter 100 with sidewalls 101 and side skirts 106 attached to the legs 104. The sidewalls 101 and side skirts 106 may be formed of a fabric material such as a polyester fabric. As previously discussed, in conventional systems, the sidewalls 101 and side skirts 106 may attach directly to the legs 104 or perimeter truss via a connection, such as a fastener attached to a strap. The connections are neither secure nor taut. Therefore, the sidewalls 101 and side skirts 106 are prone to sagging or disconnecting from the legs 104. Additionally, or alternatively, banners, flags, and/or other types of dressings may be mounted to the legs and/or frame. As an example, half walls 110 may also be mounted to the legs 104. FIG. 1B illustrates another example of a booth structure 150 with flags 180 and banners 190 may be mounted to the legs 154.

As shown in FIGS. 1A and 1B, the sidewalls 101, side skirts 106, flags 180, and banners 190 are visible from the exterior of the shelter 100. The sidewalls 101, side skirts 106, flags 180, and banners 190 may have information printed on both sides. Still, there is unused space on the interior of a shelter's dome (e.g., ceiling). Still, the space on the interior of the shelter's dome may also be used to provide information (e.g., advertisements). Conventional fastening systems do not provide a system for attaching structures, such as flags and banners to an interior of the shelter.

It is desirable to provide a system to improve a customer's ability to attach various structures to a shelter. Aspects of the present disclosure are directed to a multi-point attachment system that provides multiple points in a shelter for securely fastening a structure, such as a flag, banner, side skirt, tent, etc., to the shelter's frame. According to aspects of the present disclosure, the multi-point attachment system provides a solution for a customer to attach different structures to the interior and/or exterior of the frame.

In one configuration, the multi-point attachment system provides attachment points at a center of a shelter as well as corners of the shelter. Of course, aspects of the present disclosure are not limited to providing attachment points at the center and all corners, as various configurations are contemplated based on a customer's need.

Some shelters may have a roof structure that is elevated with a telescoping peak beam. The peak beam may be connected to a bracket (e.g., center bracket) with multiple sockets. The sockets may receive one end of the peak beam as well as ends of truss links. In one configuration, one or more attachment points are provided at the center bracket.

Figure 2:
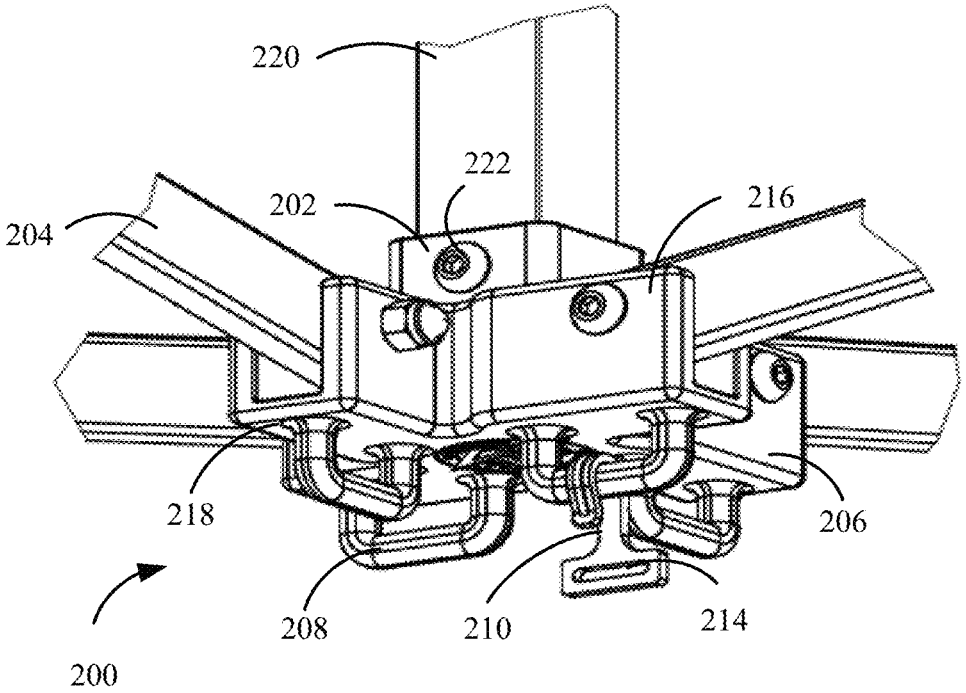
FIG. 2 illustrates an example of an element of a multi-point fixed attachment system according to aspects of the present disclosure.

FIG. 2 illustrates an example of a center bracket 200 according to aspects of the present disclosure. As shown in FIG. 2, an end of a peak beam 220 is coupled to a center socket 202 of the center bracket 200. The end of the peak beam 220 may be secured to the center socket 202 via a bolt 222 or other type of fastener. The center socket 202 may be a square shaped socket for receiving an end of the peak beam 220. Of course, the center socket 202 may have other shapes, such as a circle or other parallelogram, based on a shape of the peak beam 220.

Additionally, the center bracket 200 includes multiple side sockets 206 extending from the body of the center bracket 200. In one configuration, each socket is at substantially right angles from an adjacent socket 206. FIG. 2 illustrates the center bracket 200 with four sockets 206. Aspects of the present disclosure are not limited to the center bracket 200 with four sockets 206 as more or fewer sockets 206 are contemplated.

Each socket 206 is coupled to a truss link 204 via a bolt 222 or other type of fastener. The truss links 204 may pivot within the respective sockets 206. In one configuration, to allow a truss link 204 to pivot when coupled to a socket 206, the sockets 206 include three sides (e.g., two arms 216 and a base 218). Furthermore, as shown in FIG. 2, a handle 208 is attached to each socket 206. In one configuration, the handle 208 is u-shaped and is attached to an outer side of the base 218. The inner side of the base 218 refers to a side that is adjacent to a truss link 204. Aspects of the present disclosure are not limited to the handles 208 having a u-shape and are contemplated for other designs that allow for a fastener 210, or other apparatus, to attach to the handle. Aspects of the present disclosure are not limited to the handles 208 being attached to the outer side of the base 218 and are contemplated for the handles 208 being attached to other portions of the center bracket 200.

As shown in FIG. 2, the fastener 210 is attached to the handle 208. As an example, the fastener 210 may be a hook, clasp, clip, or other type of structure to be coupled with the handle 208 of the socket 206. An opening 214 of the fastener 210 may receive a connector from a dressing, such as a wall, sidewall, skirt, flag, and/or banner. That is, the opening 214 is specified to receive a strap or material connected to a dressing, such as a wall, sidewall, skirt, flag, and/or banner.

Figure 3:
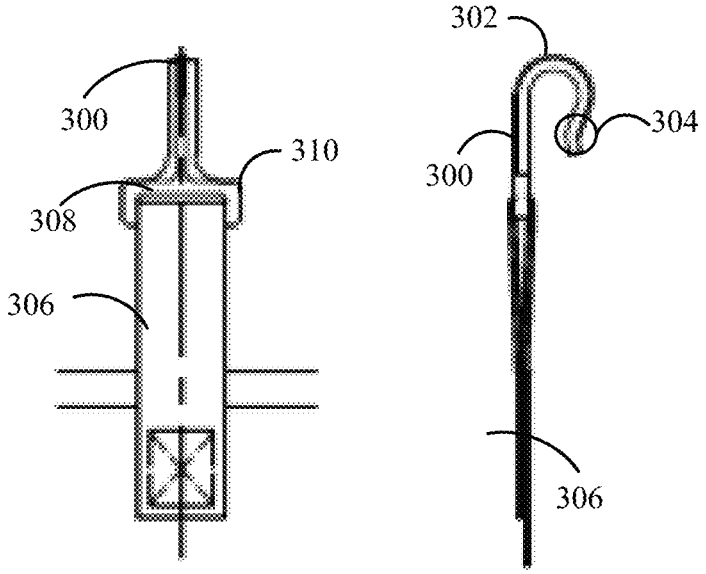
FIG. 3 illustrates an example of a connector for a multi-point fixed attachment system according to aspects of the present disclosure.

FIG. 3 illustrates an example of a fastener 300 according to aspects of the present disclosure. In one configuration, the fastener 300 is provided for attaching a dressing or structure to an attachment point, such as a handle of a bracket. As shown in FIG. 3, the fastener 300 includes a hook portion 302 that curves at a top of the fastener 300. A portion of the fastener 300 extends outward at the nose of the hook portion 302 to form a v-shaped end 304 for the fastener 300. As previously discussed, the fastener 300 is adapted to clip to a handle of a bracket. The v-shaped end 304 improves the retainment of the fastener 300 with a handle (e.g., attachment) of a multi-point attachment system.

Furthermore, as shown in FIG. 3, in one configuration, a strap 306 is extended through the opening 308 of the fastener 300. The opening 308 may be defined in a rectangular shaped end 310 of the fastener 300. Of course, aspects of the present disclosure are not limited to the fastener 300 having a rectangular shaped end 310 as other shapes are contemplated. The strap 306 may be sewn (e.g., connected) to a material of a dressing, such as a sidewall or skirt. Aspects of the present disclosure are also contemplated for the strap 306 to be connected to material of other structures, such as a tent, a flag, an inner wall extending along the roof of the canopy, or any other type of dressing (e.g., structure/fabric/material). In one configuration, the length of the strap 306 is adjustable.

Figure 4A:
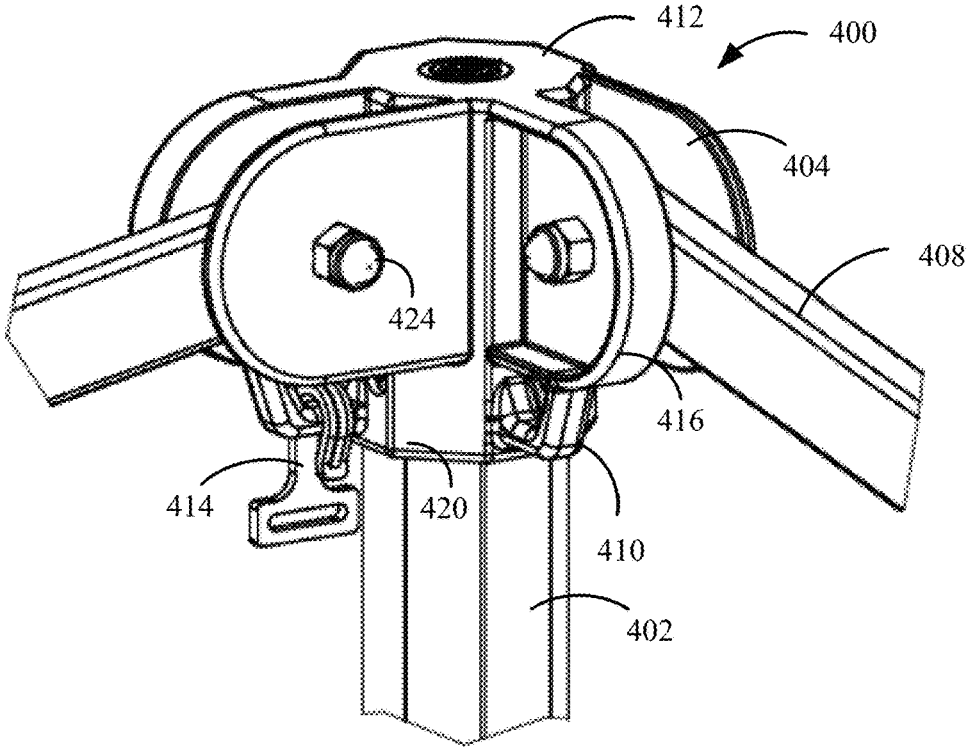
FIGS. 4A and 4B illustrate examples of elements of a multi-point fixed attachment system according to aspects of the present disclosure.
Figure 4B:
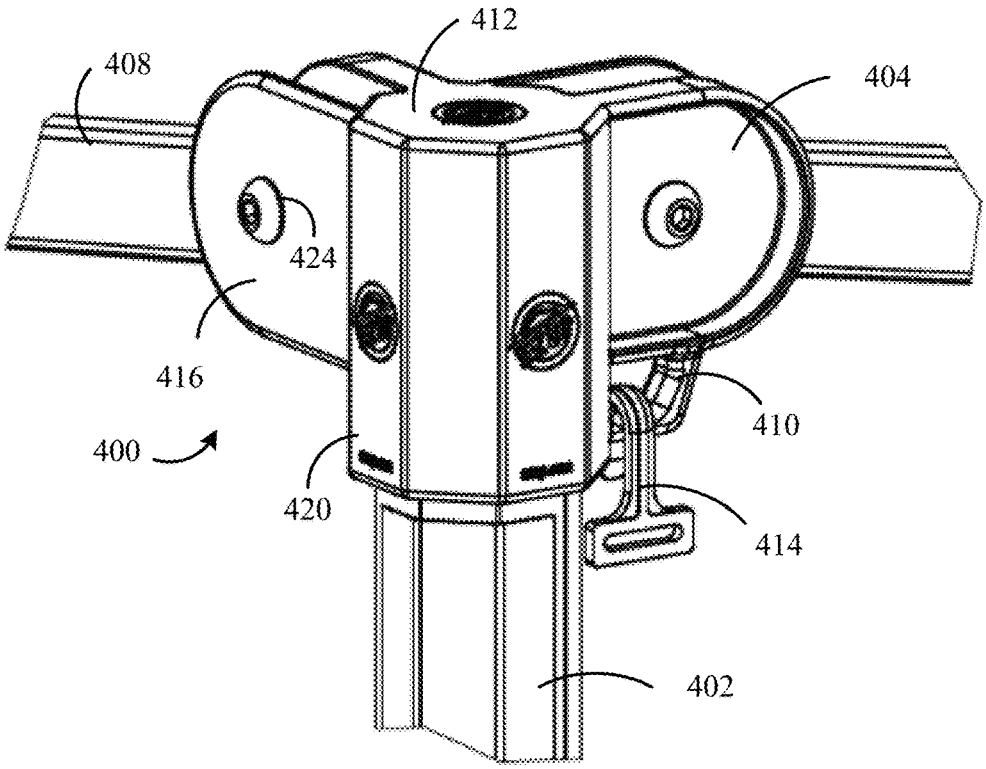

As previously discussed, a center bracket may include attachment points (e.g., handles) for a multi-point attachment center. In one configuration, attachment points are defined on leg brackets of a shelter. The attachment points on the leg brackets may be provided alternate to or in addition to the attachment points of the center bracket. FIGS. 4A and 4B illustrate examples of different views of a leg bracket 400 according to aspects of the present disclosure. FIG. 4A illustrates a first view (e.g., front view) of the leg bracket 400 and FIG. 4B illustrates a second view (e.g., back view) of the leg bracket 400. The second view is opposite of the first view. As shown in FIGS. 4A and 4B, the leg bracket 400 is connected to a leg 402 of the collapsible frame. That is, a socket 420 of the leg bracket 400 receives an end of the leg 402. The leg 402 may be attached to the socket 420 via a bolt or other attachment (not shown).

The leg bracket 400 includes multiple sockets 404 extending outward from a body 412 of the leg bracket 400. Each socket 404 may be at substantially right angle from an adjacent socket 404. Aspects of the present disclosure are not limited to two sockets 404 as shown in FIGS. 4A and 4B; the leg bracket 400 may have one or more sockets 404. For example, in one configuration, the leg bracket 400 includes only one socket 404 extending outward from a body 412 of the leg bracket 400.

An end of a link member 408 is received in each socket 404 of the leg bracket 400. The end of the link member 408 may be pivotally connected to the socket 404. Specifically, the end of the link member 408 may be attached to the socket via a bolt 424 or other attachment. The socket 404 of the leg bracket 400 includes two arms 416. As a roof and a floor are not defined for each socket 404 of the leg bracket 400, the link member 408 may pivot in an up or down direction.

In one configuration, a handle 410 (e.g., attachment point) is defined below each socket 404. A first end of the handle 410 may be attached to a bottom of one arm 416 of the socket 404 and a second end of the handle 410 may be attached to the body 412 of the leg bracket 400. Each handle 410 may be adaptable to receive a fastener 414. As previously discussed, the fastener 414 is adapted to be connected to material of a structure via a strap or other type of connector. The leg bracket 400 is not limited to receiving link members and may receive telescoping pole members or other structures of a frame of a shelter.

Figure 5A:
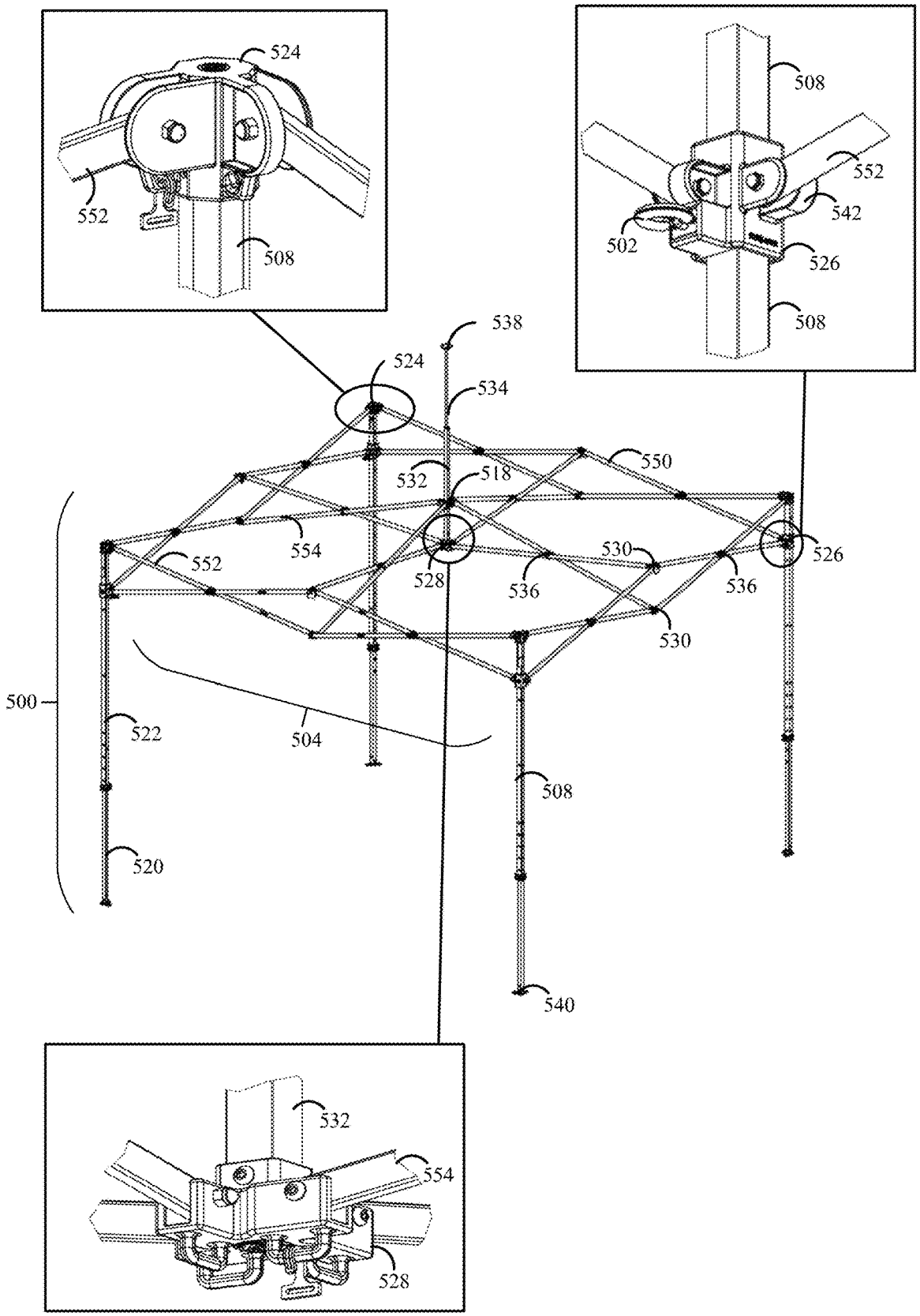
FIGS. 5A, 5B, 6A, 6B, and 7 illustrate examples of collapsible frames according to aspects of the present disclosure.

FIG. 5A illustrates an example of a frame of a shelter 500 in accordance with aspects of the present disclosure. The shelter 500 may be a modular folding shelter, such as a display booth. As shown in FIG. 5A, the frame has four sides 504 and four corners. Each side 504 may be substantially perpendicular to one or more adjacent sides 504. Of course, aspects of the present disclosure are not limited to a frame with four sides and four corners, as other configurations, such as three sides and three corners, are also contemplated. Additionally, adjacent sides 504 may be connected at an angle that is greater than or less than 90 degrees. The frame may be collapsible. In another configuration, the frame is fixed.

In one configuration, legs 508 are provided at each corner to erect the frame. The legs 508 may be telescoping (e.g., extendable). That is, each leg 508 may comprise a telescoping lower section 520 that extends from a hollow upper section 522. The telescoping lower section 520 may be slidably disposed within the hollow upper section 522. Each telescoping lower section 520 has a foot 540 for engagement with the ground. Additionally, a perimeter truss frame 550 is connected to the legs 508 via brackets 524, 526 to stabilize and support the frame of the shelter 500. The perimeter truss frame 550 may also be referred to as a perimeter truss framework.

The perimeter truss frame 550 may include multiple outer truss links 552 and multiple inner truss links 554. Two outer truss links 552 may form an outer truss link pair. The outer truss links 552 of each outer truss link pair may be pivotally connected to each other at a cross-link joint 536, such as in a scissor configuration. In one configuration, a first end of each outer truss link 552 is pivotally connected to a leg 508 via either a leg bracket 524 or a sliding bracket 526. That is, a first end of one outer truss link 552 of each outer truss link pair may be pivotally connected to a socket of the leg bracket 524. Each socket of the leg bracket 524 may include an attachment point (e.g., handle) for receiving a fastener (see FIGS. 4A-B). The first end of another outer truss link 552 of each outer truss link pair may be pivotally connected to a socket of a sliding bracket 526, such that one outer truss link 552 of an outer truss link pair is slidably connected to a corresponding leg 508. A second end of each outer truss link 552 may be connected to a second end of another outer truss link 552 at an outer joint 530. The outer joint 530 may be a three-way joint.

As shown in FIG. 5A, two inner truss links 554 may be pivotally connected at a cross-link joint 536 to form an inner truss link pair. Two inner truss links 554 may be pivotally connected, such as in the scissor configuration. In one configuration, a first end of a first inner truss link 554 is pivotally connected to a second end of two outer truss links 552 at an outer joint 530. A second end of the first inner truss link 554 of each inner truss link pair is pivotally connected to a peak slider 518. Furthermore, a first end of a second inner truss link 554 of each inner truss link pair is pivotally connected to a second end of two outer truss links 552 at an outer joint 530. A second end of the second inner truss link 554 of each inner truss link pair is pivotally connected to a socket of the center bracket 528. Each socket of the center bracket 528 may include an attachment point (e.g., handle) for receiving a fastener (see FIG. 2).

The shelter 500 may include a peak beam 532 for supporting a roof structure (not shown), such as a canopy. The peak beam 532 may be attached to a center bracket 528. The peak slider 518 may also be slidably attached to the peak beam 532. In one configuration, a peak pole 534 is telescoping (e.g., extendable) from the peak beam 532. That is, the peak beam 532 may be hollow so that the peak pole 534 may extend upward from the peak beam 532. The peak pole 534 may be slidably disposed within the peak beam 532. Additionally, the peak pole 534 may include a top bracket 538 for engaging a roof structure, such as a canopy.

The top bracket 538 may also include attachment points. In one configuration, a sail banner may be attached to an attachment point of the top bracket 538 and an attachment point on one or more leg brackets 524. Additionally, or alternatively, the sail banner may be attached to other components of the shelter. The sail banner may be used to display information on the interior of the shelter 500. In one configuration, a roof material may be placed on the shelter 500. In this configuration, the roof structure is placed over the sail banner, such that only the roof structure is visible from the exterior of the shelter 500, while both the roof structure and the sail banner are visible from the interior of the shelter 500.

FIG. 5A illustrates an example of a sliding bracket 526 according to aspects of the present disclosure. As shown in FIG. 5A, a leg 508 passes through an opening of the sliding bracket 526. A pin 502 is used to engage the sliding bracket 526 with an opening in the leg 508 to keep the sliding bracket 526 in a desired position. The sliding bracket 526 includes one or more sockets 542 for engaging an end of a truss link, such as an outer truss link 552. A truss link may pivot within the socket 542. In one configuration, the sliding bracket 526 includes one or more attachment points of the multi-point attachment system.

Figure 5B:
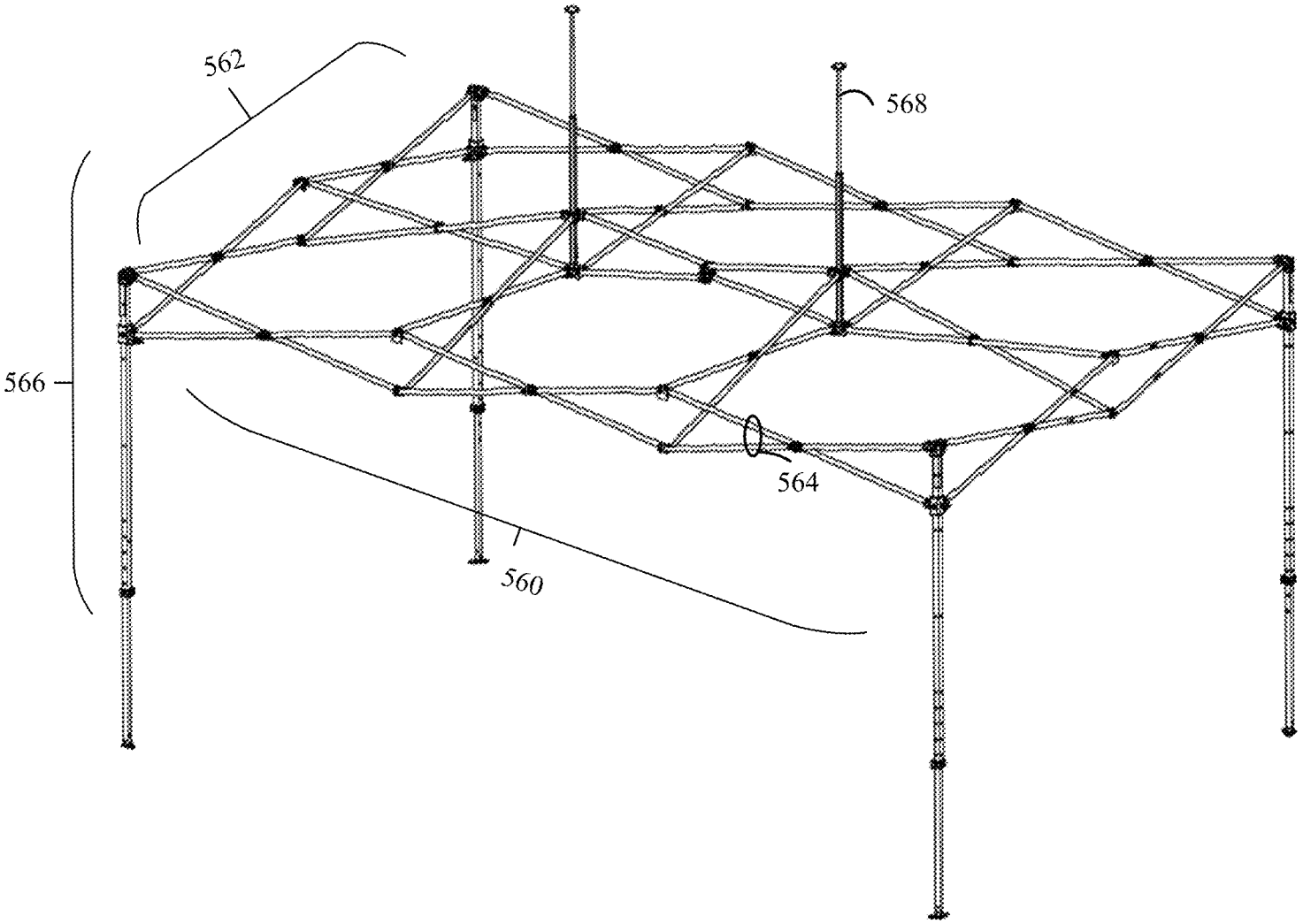

Aspects of the present disclosure are not limited to two outer truss link pairs per side. The number of outer truss link pairs, per side, may be less than or greater than two. For example, as shown in FIG. 5B, a first side 560 of a shelter 566 may include three outer truss link pairs 564 and a second side 562 may include two outer truss link pairs 564. In this example, the shelter 566 may include multiple peak beams 568. The other portions of the frame of the shelter 566 are similar to the frame of the shelter 500 of FIG. 5A. For brevity, the elements of the shelter 566 of FIG. 5B that are the same as the elements of the shelter 500 of FIG. 5A will not be discussed in detail.

Figure 6A:
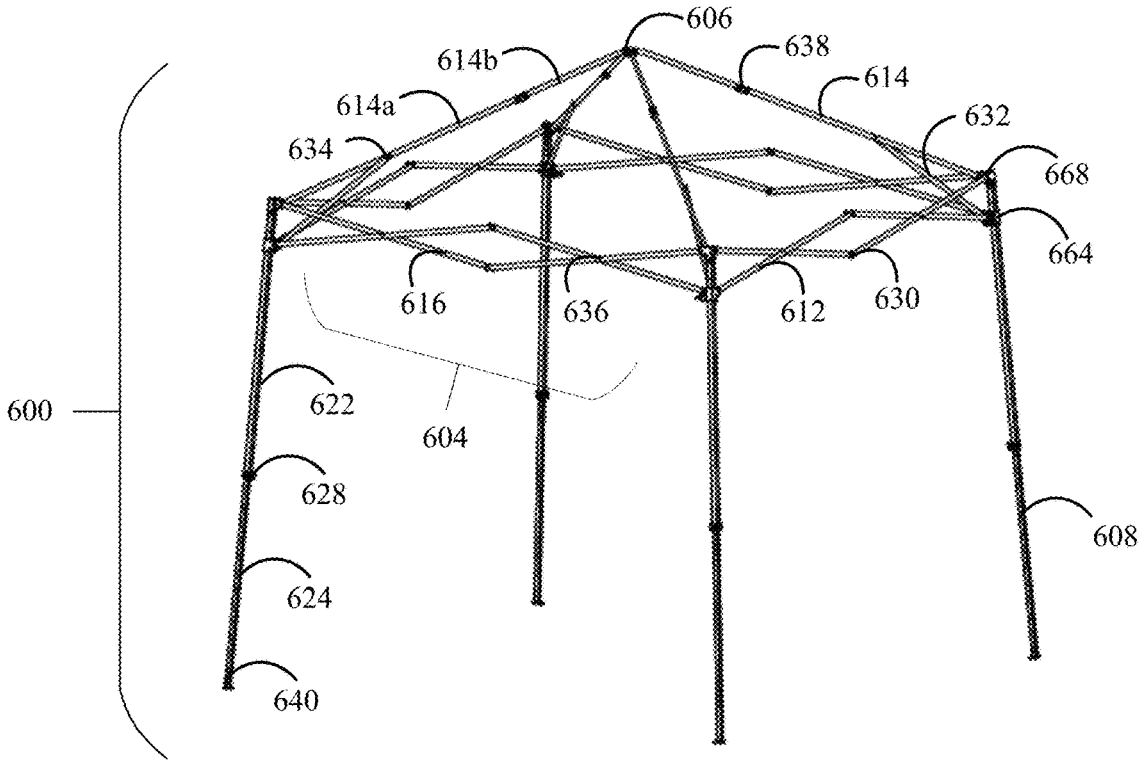

Aspects of the present disclosure are not limited to the shelters of FIGS. 5A and 5B as other types of shelters may be used for the multi-point attachment system. FIG. 6A illustrates an example of a frame for a shelter 600 with a peak shape roof in accordance with aspects of the present disclosure. The shelter 600 may be a modular folding shelter, such as a display booth. As shown in FIG. 6A, the shelter 600 has four sides 604 and four corners. Each side 604 may be substantially perpendicular to one or more adjacent sides 604. Of course, aspects of the present disclosure are not limited to a shelter 600 with four sides and four corners, as other configurations are also contemplated. The shelter 600 may be collapsible.

In one configuration, legs 608 are provided at each corner to erect the shelter 600. The legs 608 may be telescoping (e.g., extendable). That is, each leg 608 may comprise a telescoping lower section 624 that extends from a hollow upper section 622. The telescoping lower section 624 may be slidably disposed within the hollow upper section 622. A slider 628, such as a slider with a pull pin, may be used to extend the telescoping lower section 624 from the hollow upper section 622. Each telescoping lower section 624 has a foot 640 for engagement with the ground. Additionally, a perimeter truss frame 616 is connected to the legs 608 for stability and support.

The perimeter truss frame 616 may include multiple outer truss links 612. Two pivotally connected outer truss links 612 may form an outer truss link pair. The outer truss links 612 of each outer truss link pair may be pivotally connected to each other at a cross-link joint 636, such as in a scissor configuration. In one configuration, a first end of each outer truss link 612 is pivotally connected to a leg 608 via a sliding bracket 664 or a leg bracket 668. Specifically, the first end of one outer truss link 612 of each outer truss link pair may be pivotally connected to a socket of a sliding bracket 664. The first end of another outer truss link 612 of each outer truss link pair may be pivotally connected to a socket of the leg bracket 668, such that each outer truss link 612 is pivotally connected to a corresponding leg 608. The leg bracket 668 and/or the sliding bracket 664 may include one or more attachment points (see FIGS. 4A-B). A second end of each outer truss link 612 may be connected to a second end of another outer truss link 612 at an outer joint 630.

As shown in FIG. 6A, the frame may include multiple upper peak truss links 614 and lower peak truss links 632. A first end of each upper peak truss link 614 may be pivotally connected to a leg bracket 668. A second end of each upper peak truss link 614 may be pivotally connected to a peak center bracket 606. The center bracket 606 may include one or more attachment points of the multi-point attachment system. Each upper peak truss link 614 may also include a peak joint 638, such that a first portion 614*a* and a second portion 614*b* of each first peak truss link 614 are foldable. A first end of a lower peak truss link 632 may be pivotally connected to the upper peak truss link 614 at a truss joint 634. A second end of the lower peak truss link 632 may be pivotally connected to socket of a sliding bracket 664. Each socket of a sliding bracket 664 may include a handler for receiving a fastener.

The lower peak truss links 632 may provide support to a corresponding (e.g., adjacent) upper peak truss link 614. The upper peak truss links 614 form a peak for supporting a roof structure (not shown), such as a canopy. The lower peak truss links 632 and/or upper peak truss links 614 may be made of a rigid material or flexible material. The truss links may form a dome shape roof, a pyramid shape roof, or other type of roof.

Figure 6B:
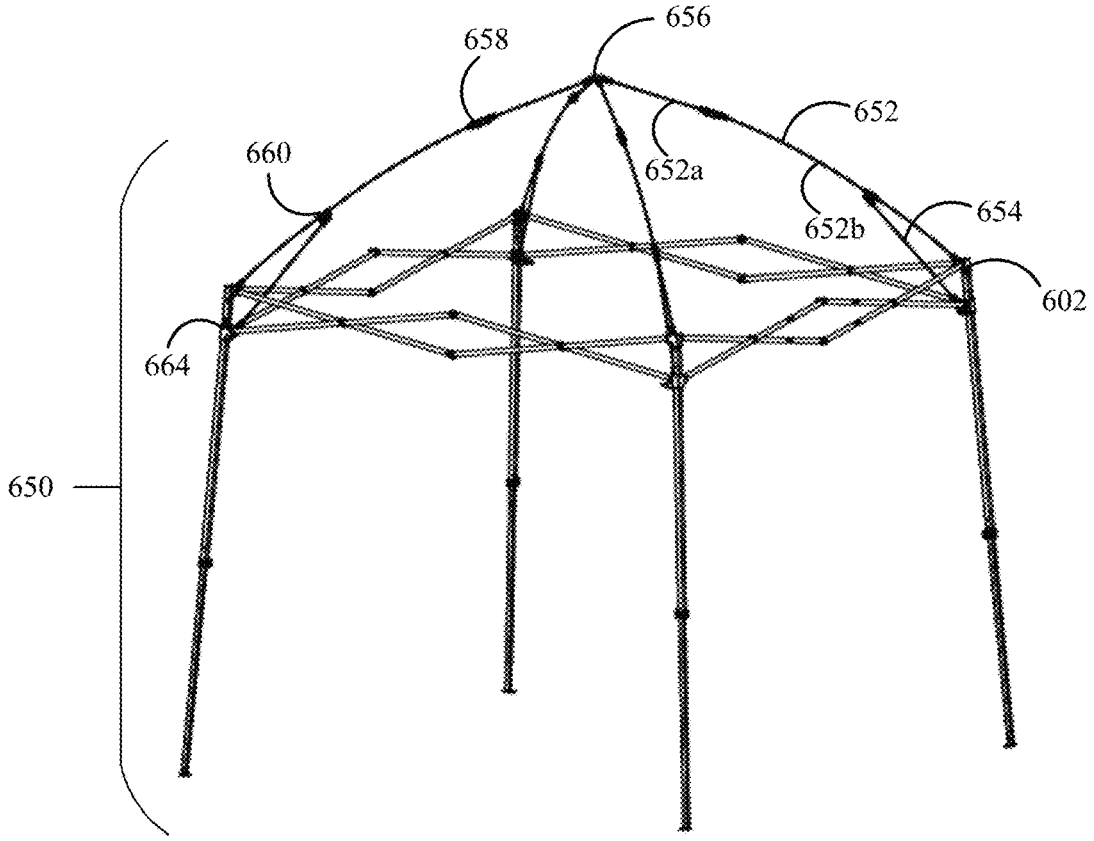

FIG. 6B illustrates an example of a frame of a shelter 650 with a dome shape roof according to aspects of the present disclosure. The frame of the shelter 650 is similar to the frame of the shelter 600 of FIG. 6A. For brevity, the elements of the shelter 650 of FIG. 6B that are the same as the elements of the shelter 600 of FIG. 6A will not be discussed in detail.

As shown in FIG. 6B, the frame may include multiple upper peak truss links 652 and lower peak truss links 654. A first end of each upper peak truss link 652 may be pivotally connected to a leg bracket 602. The leg bracket 602 may include a handle on each socket (see FIGS. 4A-4B). A second end of each upper peak truss link 652 may be pivotally connected to a dome center bracket 656. Each upper peak truss link 652 may also include a joint 658, such that a first portion 652*a* and a second portion 652*b* of each upper peak truss link 652 are foldable. A first end of a lower peak truss link 654 may be pivotally connected to the upper peak truss link 652 at a joint 660. A second end of the lower peak truss link 654 may be pivotally connected to a socket of a sliding bracket 664.

The lower peak truss links 654 may provide support to a corresponding (e.g., adjacent) upper peak truss link 652. The upper peak truss links 652 and lower peak truss links 654 form a dome for supporting a roof structure (not shown), such as a canopy. The lower peak truss links 654 and the upper peak truss links 652 may be a flexible material. For example, the lower peak truss links 654 and the upper peak truss links 652 may be flexible rods, such as composite fiber rods. The flexibility improves wind resistance.

As an example, a tent shelter, such as a cube tent, gazebo, or a structure with a roof, may be erected within the shelter 650. In one configuration, the tent shelter may have a cube shape and the sides of the tent shelter may be attached to attachment points on the leg brackets 602. Furthermore, a strap may be attached to the roof of the structure and an attachment point of the dome center bracket 656. The dome of the shelter 650 may then be covered with a roof fabric. The flexibility of the upper peak truss links 652 as well as the connection between the roof of the tent shelter and the dome of the shelter 650 improves the wind resistance of the structure. Aspects of the present disclosure are not limited to erecting a tent shelter in shelters with flexible peak truss links, as the tent shelter may be erected in any type of shelter with a multi-point attachment system.

Figure 7:
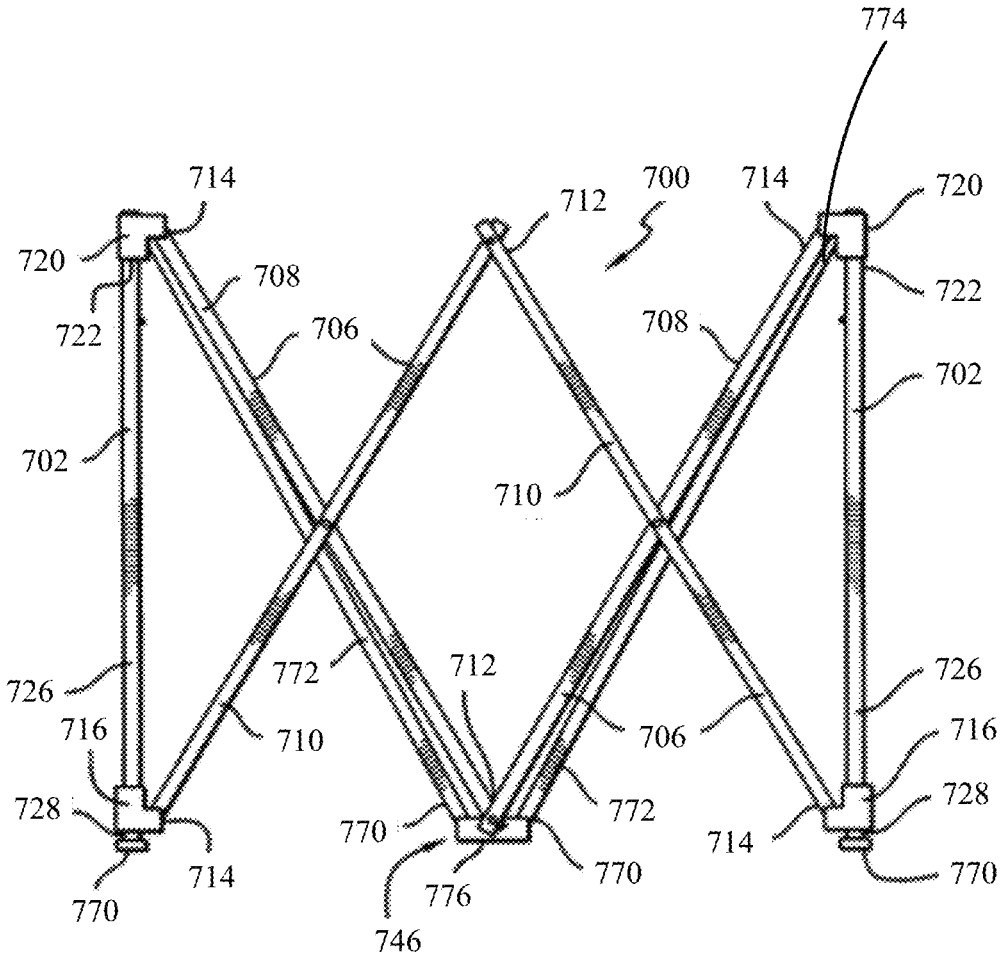

FIG. 7 illustrates an example of a shelter in a partially collapsed position. As shown in FIG. 7, a perimeter truss link assembly 700 having multiple perimeter truss pairs of link members 706 is connected to each leg 702. Each of the perimeter truss pairs including first link members 708 and second link members 710 that are pivotally connected together, such as in a scissors configuration. The first link member 708 and second link members 710 have inner ends 712 and outer ends 714. The outer end 714 of each first link member 708 connected to the upper end of one leg 702 via a leg bracket 720, and the outer end 714 of each second link member 710 being connected to a sliding leg bracket member 716 so as to be slidably connected to the leg 702. The inner ends 712 may be pivotally connected to each other. Each leg 702 may comprise a hollow upper section 726 and a telescoping lower section 728, with the lower section slidably disposed within the upper section, with the lower section having a foot section 770 for engagement with the ground. An end 722 of each leg 702 is connected to the leg bracket 720.

Figure 8:
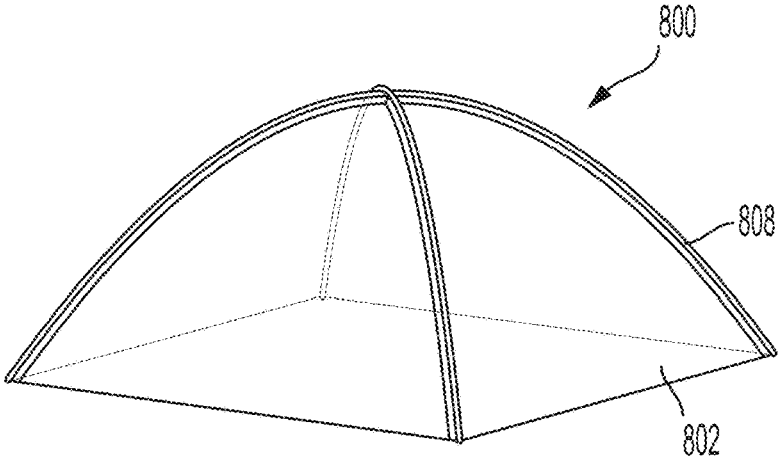
FIG. 8 (Prior Art)
FIGS. 8, 9A, and 9B illustrate examples of portable rooms.

As previously discussed, a conventional portable room, such as a tent, may be assembled by erecting fabric using poles, stakes, and/or rope. FIG. 8 illustrates an example of a conventional portable room 800. As shown in FIG. 8, the portable room 800 includes fabric 802 and poles 808. Each pole 808 may include multiple interlocking pole pieces. The pole 808 is assembled by interlocking the pole pieces. Of course, the pole 808 may be interlocking or may be one piece. The poles 808 may be flexible to create an arch in the fabric 802. Furthermore, the poles 808 may be attached to the fabric 802 via tubes in the fabric 802, or via other attachments. Each end of a pole 808 may be secured to the ground via a stake (not shown). Finally, for added stability, ropes (not shown) may be attached to the fabric 802 and the ground.

As is known to those of skill in the art, erecting the conventional portable room 800 via the poles 808 is cumbersome and time consuming. Furthermore, the conventional portable room 800 may have a low profile (e.g., low height). The low profile may reduce instability caused by wind or other elements. Still, the low profile of the portable room 800 reduces an amount of space that is available.

To increase an amount of space, the length of the poles 808 may be increased to provide a higher arch for the portable room 800. The higher arch may increase the amount of space within the portable room 800. Still, as the arch increases, the wind stability decreases. Additionally, or alternatively, the footprint of the portable room 800 may increase. That is, a perimeter of the fabric 802 may be increased. However, as the footprint increase, the wind stability decreases.

Figure 9A:
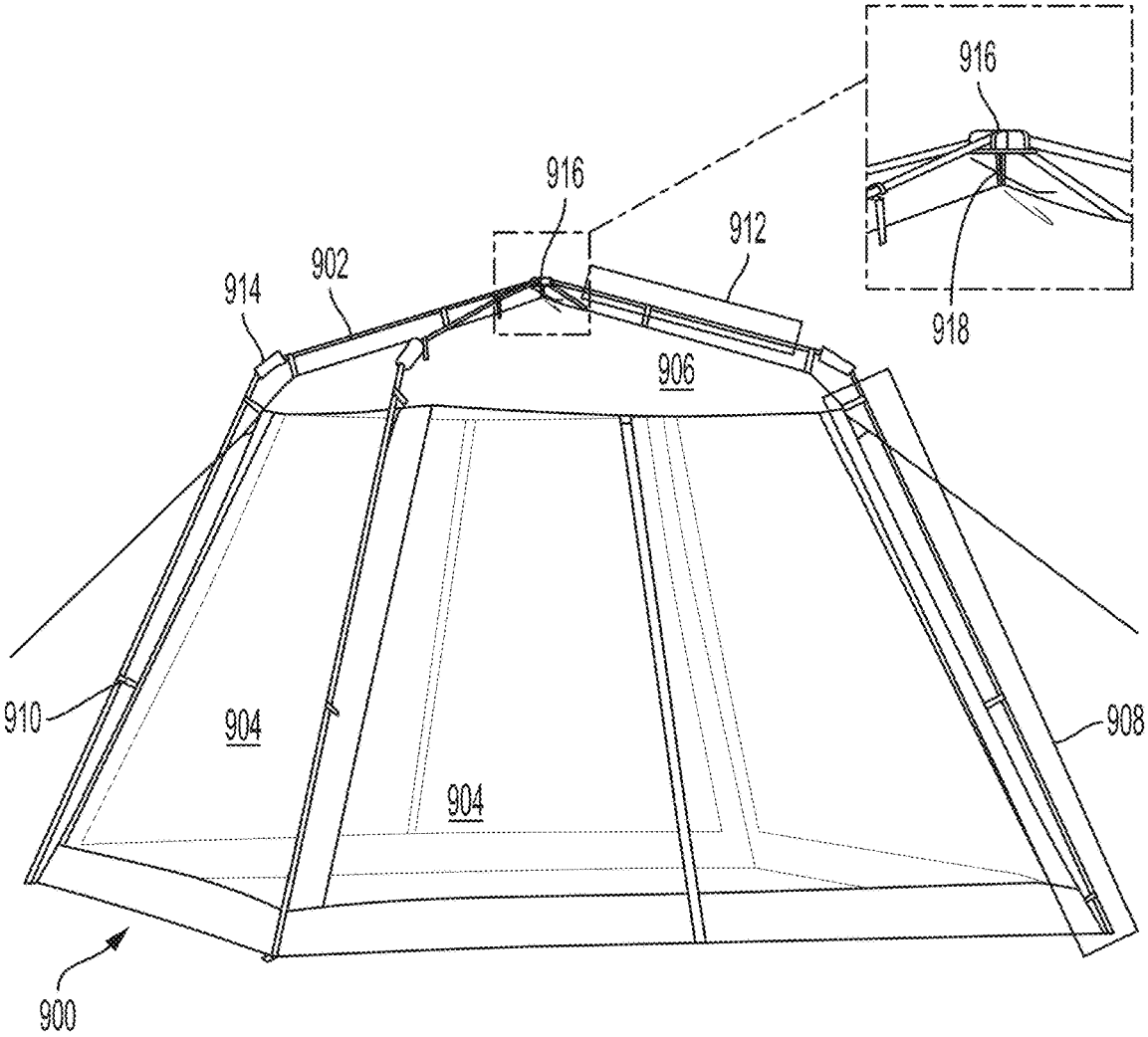
FIG. 9A (Prior Art)

In some cases, to increase an amount of space and to also reduce assembly time, conventional portable rooms may be attached to an erectable frame. FIG. 9A illustrates an example of a conventional portable room 900 attached to an erectable frame 902 (e.g., collapsible frame). The frame 902 may include multiple legs 908 and multiple peak links 912. Each leg 908 is attached to a peak link 912 via a joint 914. Furthermore, the peak links 912 may be connected to a center bracket 916.

As shown in FIG. 9A, walls 904 and a roof 906 of the portable room 900 are attached to the frame 902. Specifically, each edge of two adjacent walls 904 is attached to a leg 908 of the frame 902. The edges may be attached to the legs 908 via fasteners 910. Additionally, the roof 906 is attached to the peak links 912 via fasteners 910.

A center of the roof 906 may be attached to the center bracket 916 via a center fastener 918. The center fastener 918 may latch onto the center bracket 916. Alternatively, the center fastener 918 may be tied to a fastener of the center bracket 916. In this example, the roof 906 extends at an upward angle that is similar to an angle of the peak of the frame 902. Still, the roof 906 and the angle of the peak may be substantially flat. A canopy (not shown) may be placed over the peak links 912 to provide additional protection from the elements. The peak links 912 of the frame 902 are made of rigid tubes, such as metal or fiberglass. That is, the peak links 912 are not flexible.

Figure 9B:
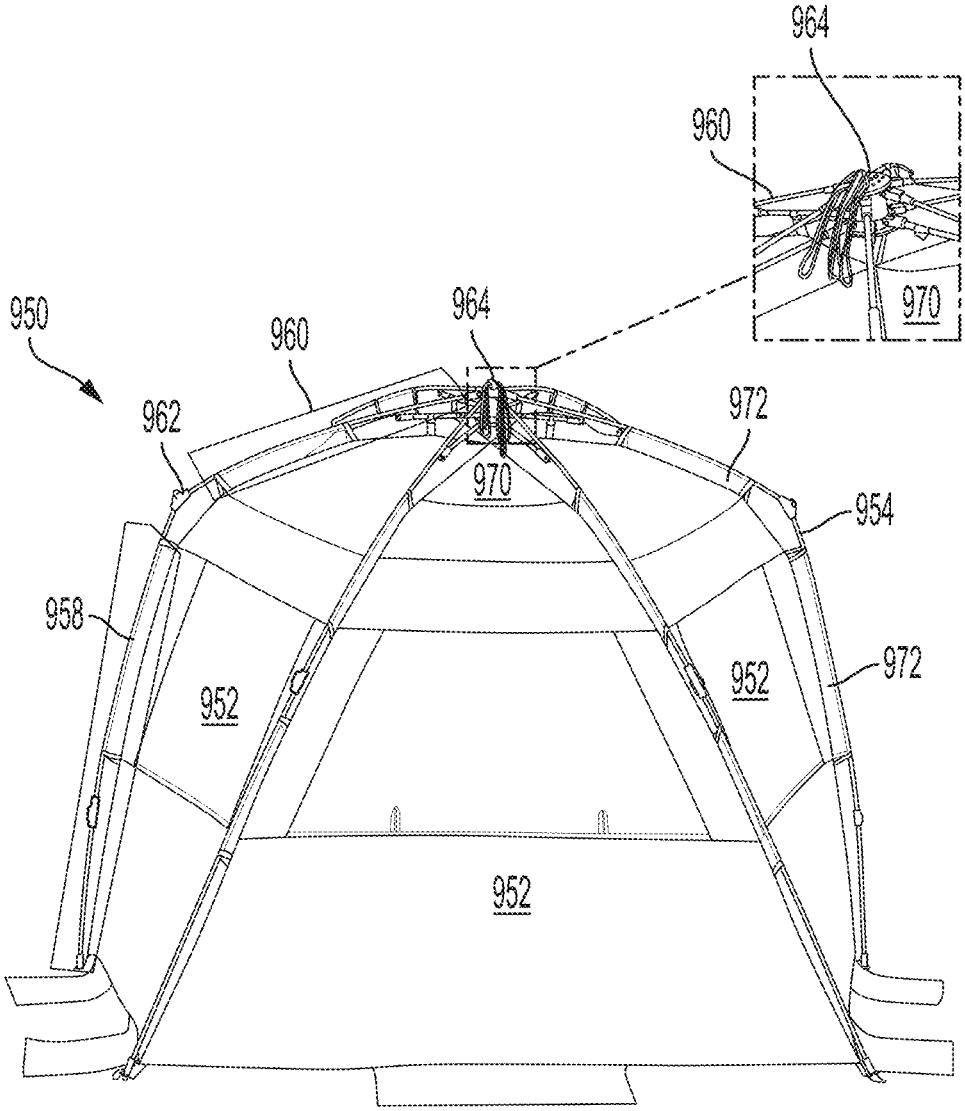
FIG. 9B (Prior Art)

FIG. 9B illustrates another example of a conventional portable room 950 attached to an erectable frame 954 (e.g., collapsible frame). The frame 954 may include multiple legs 958 and multiple peak links 960. Each leg 958 is attached to a peak link 960 via a joint 962. Furthermore, the peak links 960 may be connected to a center bracket 964.

As shown in FIG. 9B, walls 952 and a roof 970 of the portable room 950 are attached to the frame 954. Specifically, each edge of two adjacent walls 952 is attached to a leg 958 of the frame 954. The legs 958 and peak links 960 may pass through tubes 972. In this example, a center of the roof 970 is not attached to the center bracket 964. As shown in FIG. 9B, the roof 970 extends at an upward angle that is similar to an angle of the peak of the frame 954. The peak links 960 are made of rigid tubes, such as metal or fiberglass. That is, the peak links 960 are not flexible.

Although the portable rooms 900, 950 of FIGS. 9A-9B may provide additional space in comparison to the portable room 800 of FIG. 8, the portable rooms 900, 950 may be unstable due to their profile (e.g., height). Additionally, regardless of whether a canopy is placed over the peak, the rigid nature of the peak links 912, 960 reduces the wind resistance of the portable rooms 900, 950. Therefore, the portable rooms 900, 950 may topple in high winds.

Aspects of the present disclosure are directed to a portable room and shelter with improved wind resistance. Furthermore, aspects of the present disclosure reduce assembly time based on the use of various brackets provided on a frame of a shelter.

In one configuration, to improve wind resistance, a flexible center strap connects a roof of the portable room to peak links of a frame. The connection between the portable room and the peak links via the flexible center strap provides flexibility to the portable room and the frame, thereby improving wind resistance.

Figure 10A:
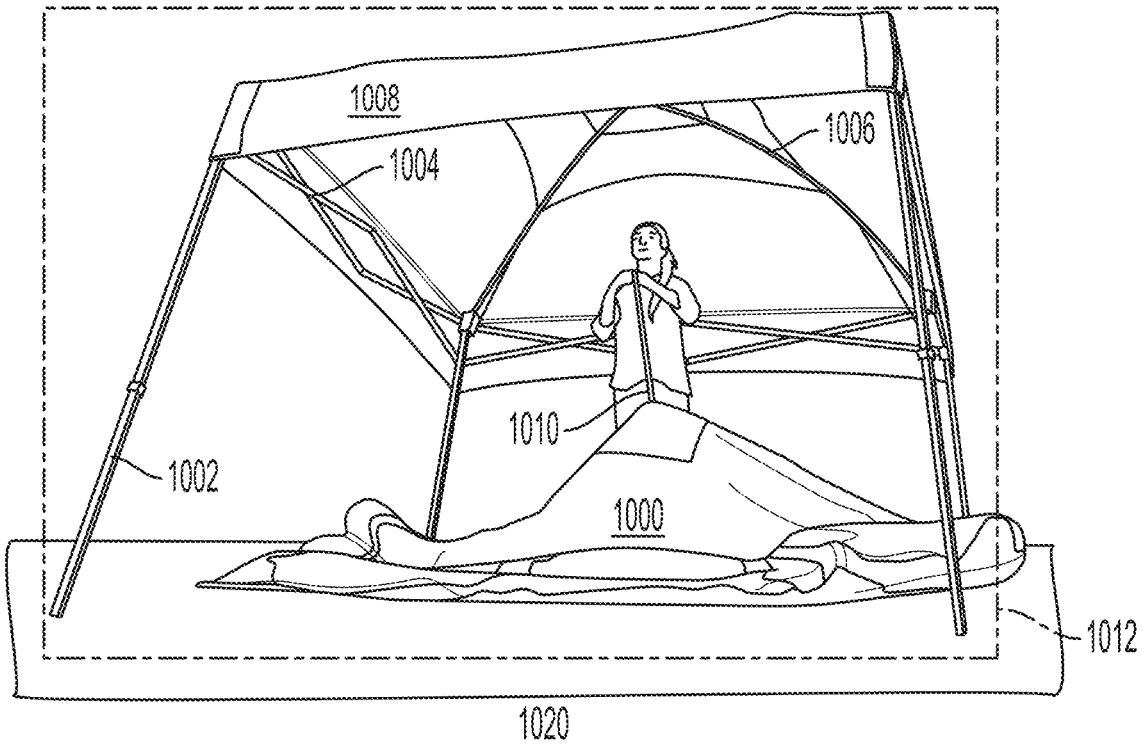
FIGS. 10A, 10B, 10C, 10D, and 10E illustrate examples of portable rooms according to aspects of the present disclosure.
Figure 10A:
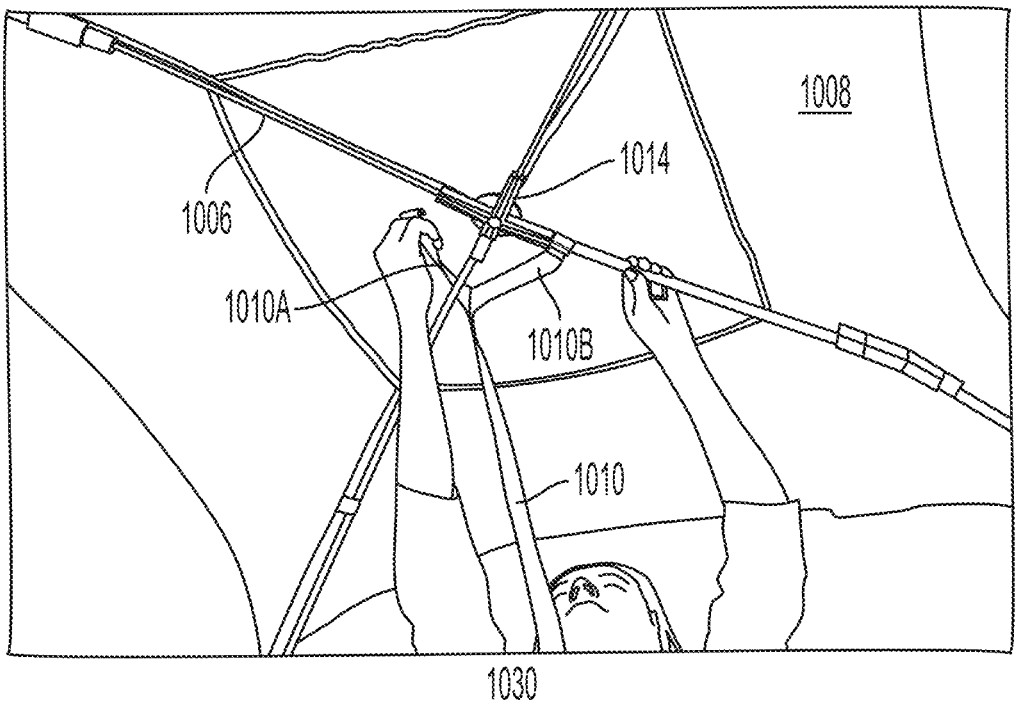

FIG. 10A illustrates an example of assembling a portable room 1000 according to aspects of the present disclosure. As shown in FIG. 10A, at block 1020, the portable room 1000 is placed within an area defined by a portable shelter 1012. A frame of the portable shelter includes multiple legs 1002, perimeter truss links 1004, and flexible peak links 1006 (See FIG. 6B). A canopy 1008 may be placed over the perimeter truss links 1004 and peak links 1006.

In one configuration, a flexible strap 1010 is attached to a roof of the portable room 1000. When assembling the portable room 1000, the flexible strap 1010 may be attached to one or more peak links 1006. At block 1030, the flexible strap 1010 is attached to two flexible peak links 1006. An end of the flexible strap 1010 may split into a first arm 1010A and a second arm 1010B. Each arm 1010A, 1010B may attach to a different peak link 1006. The arms 1010A, 1010B may also attach to handles (not shown) of a center bracket 1014 (See FIG. 5A). Of course, the flexible strap 1010 may include more than two arms. In another configuration, the flexible strap 1010 is a single piece. Each end of the flexible strap 1010 includes a fastener for attaching to the flexible peak link 1006 or the handle of the center bracket 1014.

By attaching the flexible strap 1010 to the flexible peak links 1006 or the handle of the center bracket 1014, the wind resistance of the portable room is increased based on the flexibility of the flexible strap 1010 and the flexible peak links 1006. The flexible peak links 1006 may also attach to rigid peak links (See FIG. 6A). After attaching the flexible strap 1010 to the flexible peak links 1006, other portions of the portable room 1000 may be attached to the portable shelter 1012.

Figure 10B:
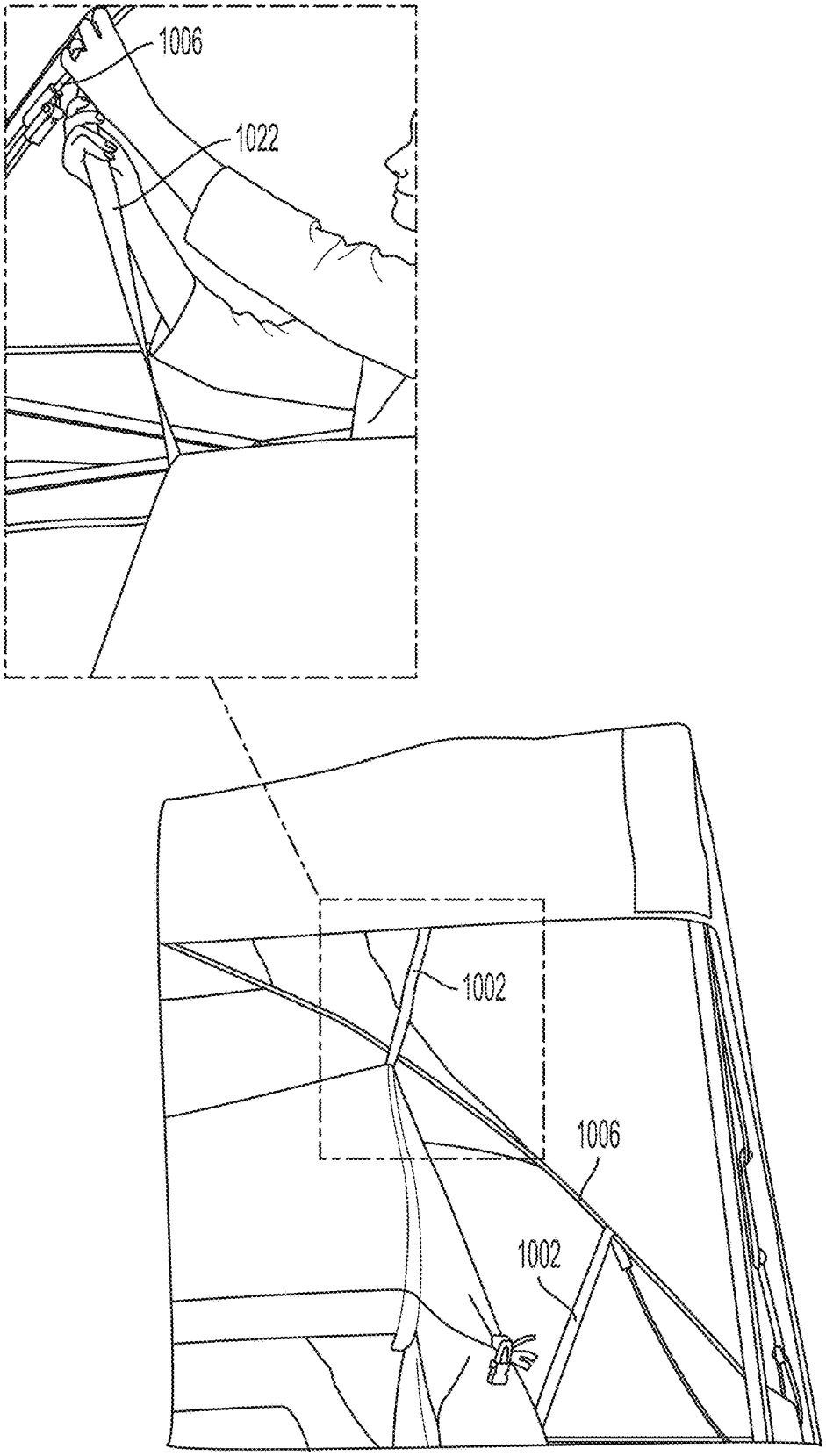

As shown in FIG. 10B, roof straps 1022 may be attached to the flexible peak links 1006. The portable room 1000 may include multiple roof straps 1022. For example, the portable room 1000 may include four roof straps 1022. Each roof strap 1022 may be defined on an edge of a roof and a sidewall of the portable room 1000.

Figure 10C:
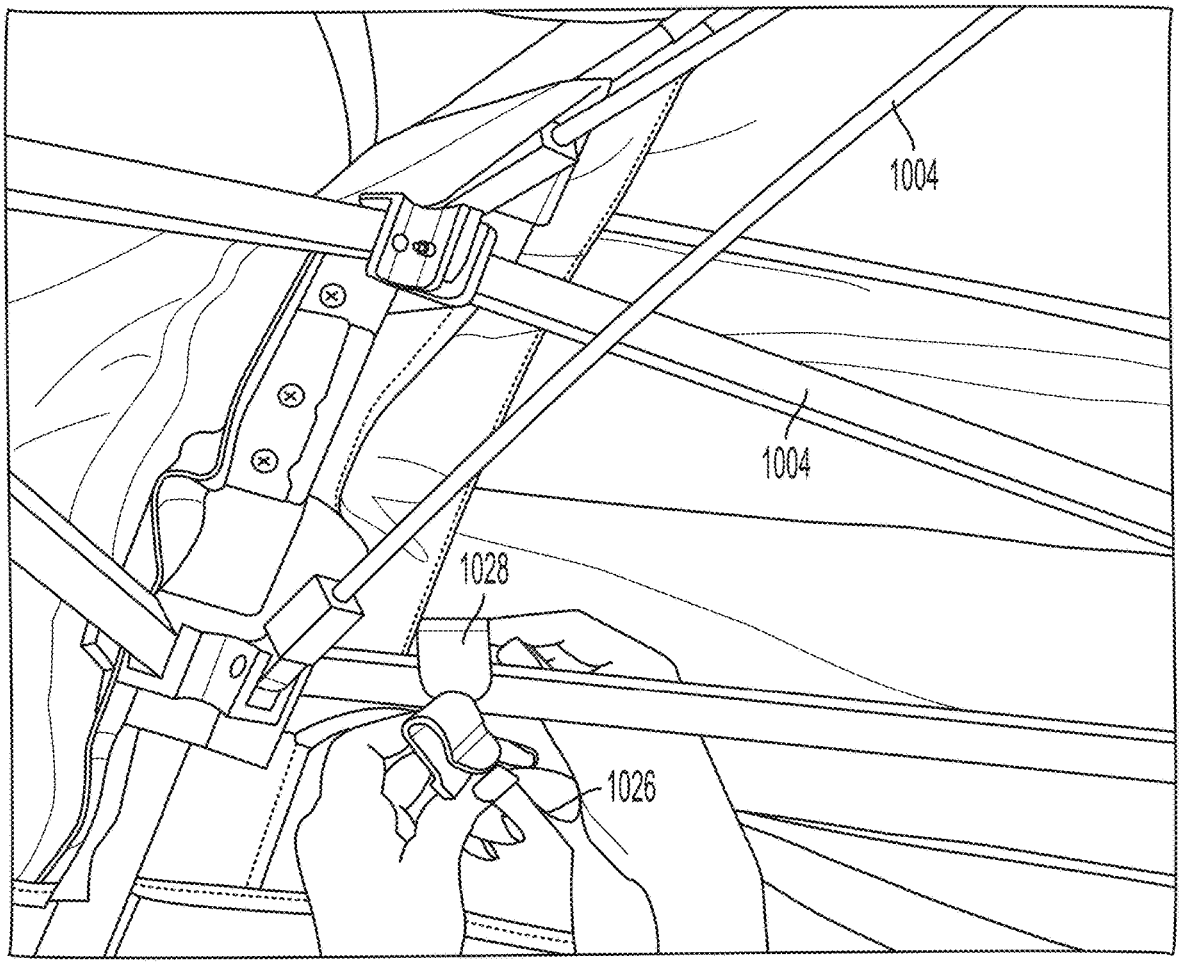

Additionally, as shown in FIG. 10C, upper edge straps 1026 may be attached to the perimeter truss links 1004. One or more upper edge straps 1026 may be attached to each upper corner of the portable room 1000. The upper corner may be defined as an area where two adjacent sidewalls attach to the roof. For example, the portable room 1000 may include upper edge straps 1026 at each upper corner. The upper edge straps 1026 may attach to the perimeter truss links 1004 via fasteners 1028. The upper edge straps 1026 may also attach to handles (not shown) of leg brackets (See FIG. 5A).

Figure 10D:
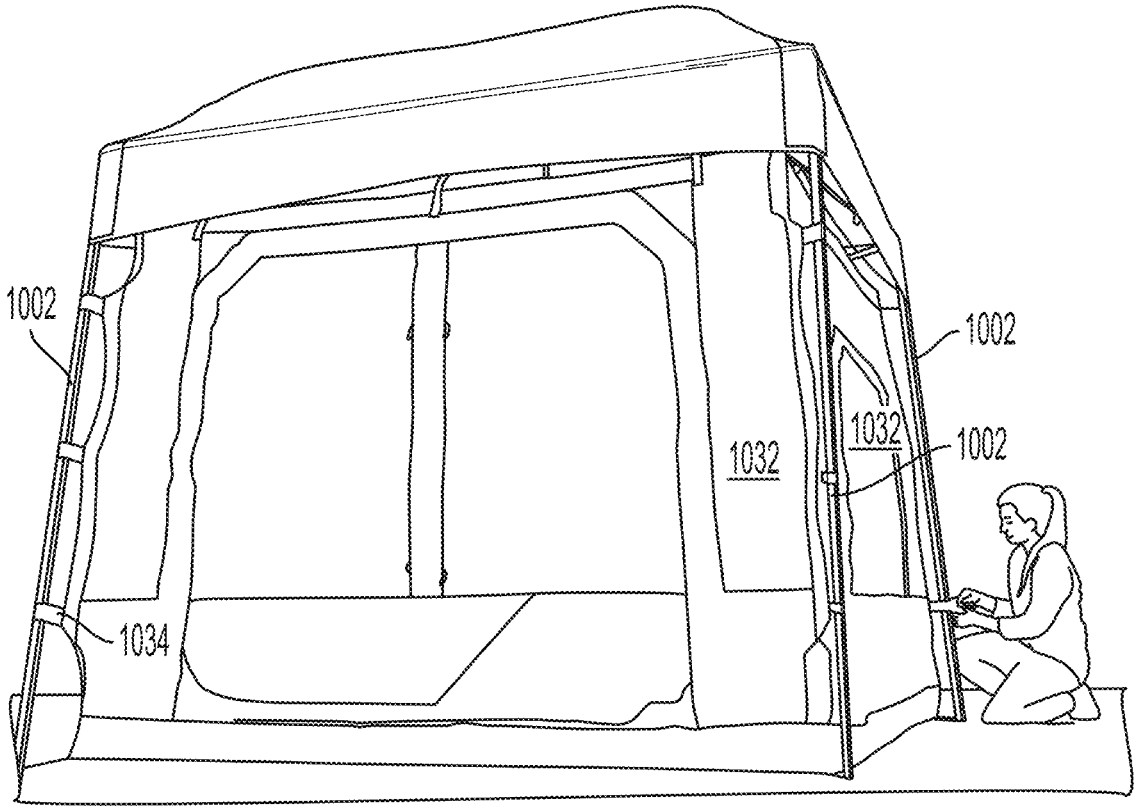

Furthermore, as shown in FIG. 10D, multiple edge straps 1034 may be attached to each leg 1002. The edge straps 1034 may wrap around each leg 1002. The edge straps 1034 may use hook fasteners, hook and loop fasteners (e.g., VELCRO™), or another type of fastener to attach to each leg 1002. The edge straps 1034 may be defined on an edge where two adjacent sidewalls 1032 meet.

Figure 10E:
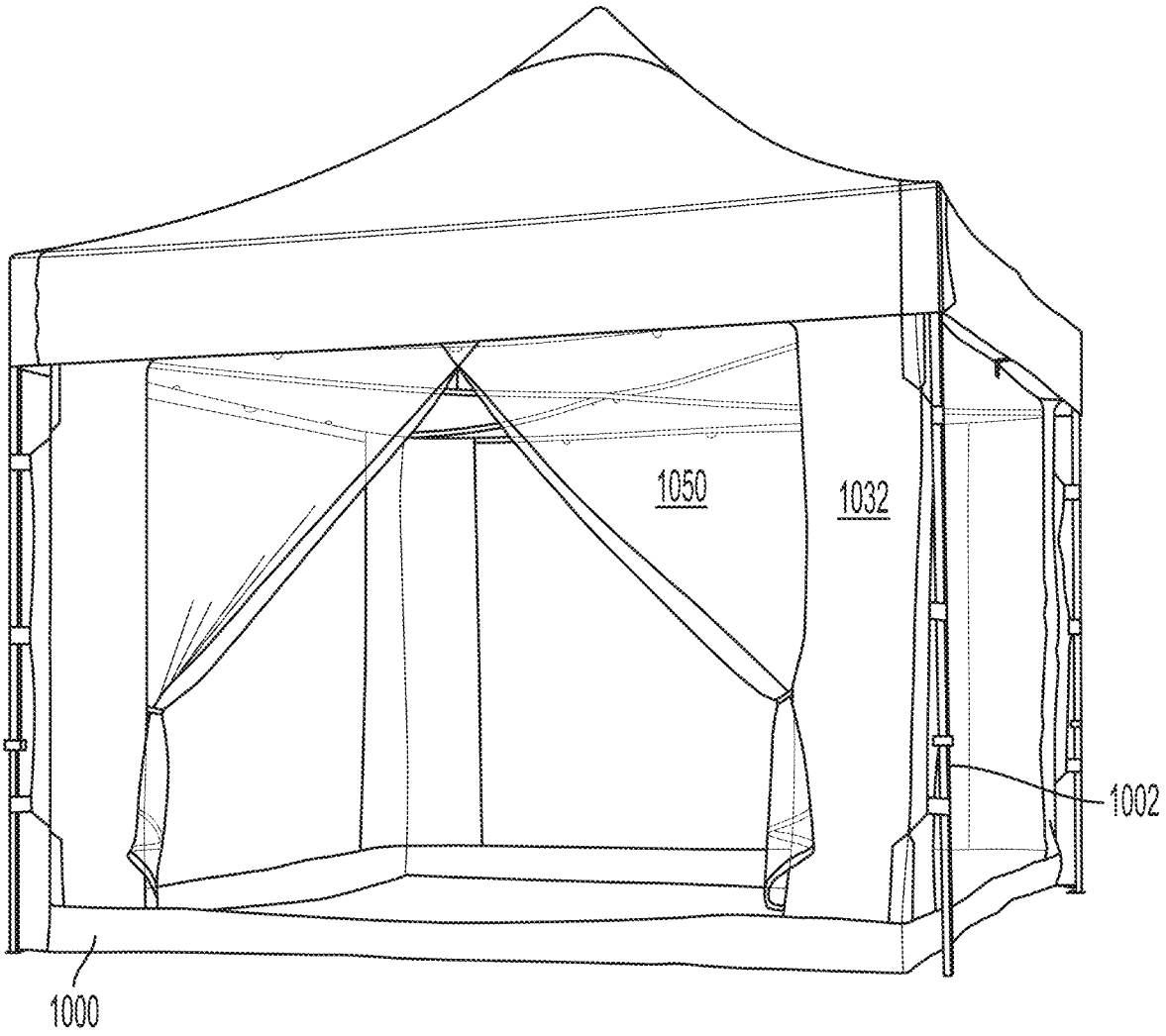

As shown in FIG. 10D, the sidewalls 1032 may be substantially opaque. In one configuration, as shown in FIG. 10E, a mesh-screen 1050 may be defined on one or more sidewalls 1032 of a portable room 1000. For example, as shown in FIG. 10E, the mesh-screen 1050 is defined on each sidewall 1032. One or more of the mesh-screens 1050 may be configured to open and close. For example, a zipper may be provided on the mesh-screen 1050 to open and close the mesh-screen 1050 to allow access to an inner area of the portable room 1000.

In another configuration, the sidewalls 1032 may be airtight. That is, the sidewalls 1032 may provide a sealed enclosure such that elements within the portable room 1000 do not venture into an exterior environment of the portable room 1000. The airtight portable room 1000 may be used as a forensics lab (e.g., crime scene lab). The airtight portable room 1000 may also be used as a decontamination chamber. In this example, an input hose may provide water to a shower fixture within the interior of the portable room 1000 and a drainage hose may drain water from the interior of the portable room 1000. The portable room 1000 may have many other uses. A size of the portable room 1000 is not limited to the sizes discloses herein. The portable room 1000 may be larger or smaller.

As discussed, it may be desirable to integrate compartments (e.g., pockets) into the ceiling of a portable room. In one configuration, to improve air quality, the pockets receive filters. Specifically, the filters may be used for dust containment and improved air quality. The air quality refers to the air quality within the portable room or the quality of the air surrounding the portable room.

Figure 11:
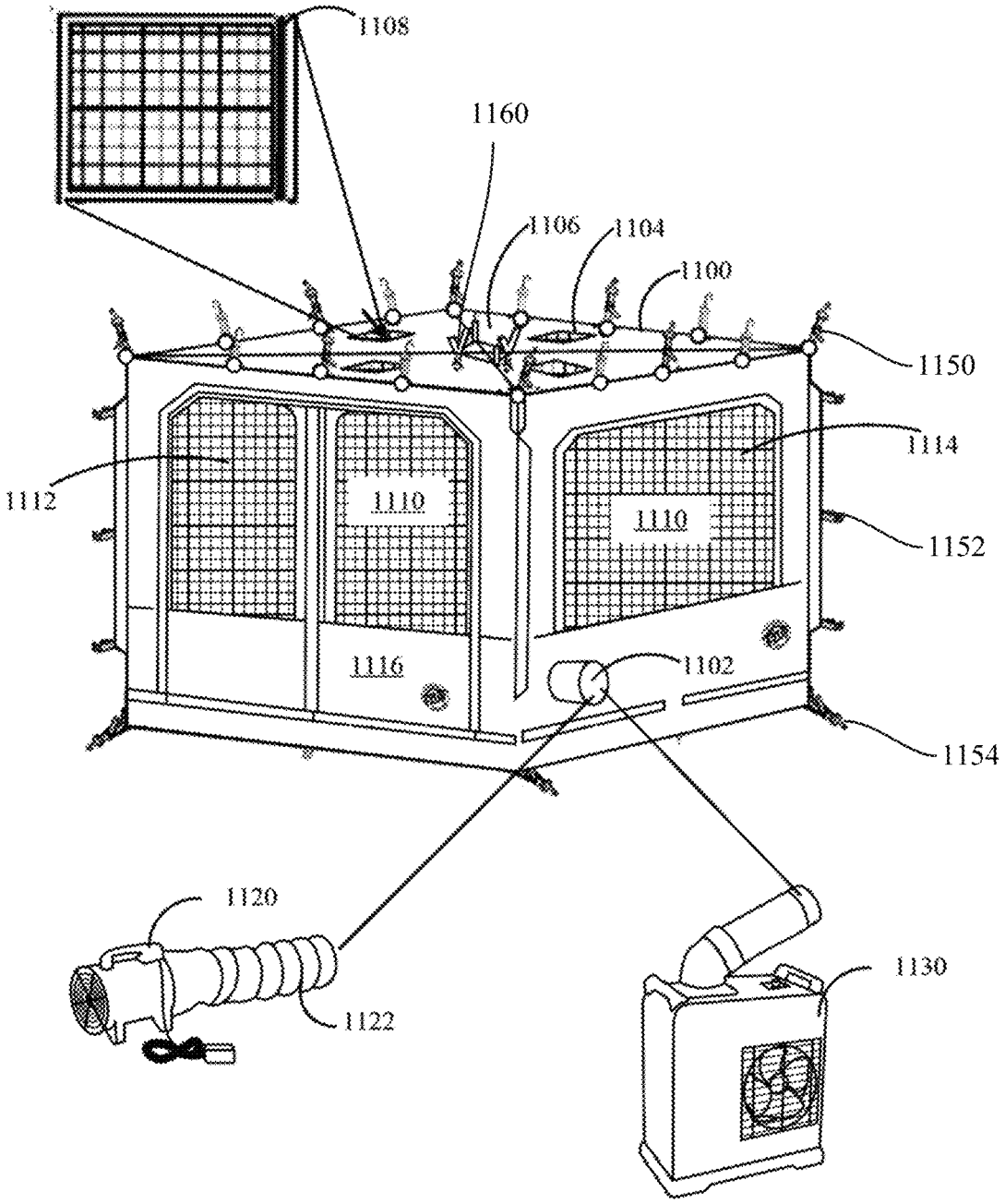
FIG. 11 illustrates an example of a portable shelter with multiple filters according to aspects of the present disclosure.

FIG. 11 illustrates an example of a portable room 1100 with an air filtration system according to aspects of the present disclosure. As shown in FIG. 11, the air filtration system may include a vent 1102 and a ventilation fan 1120. The vent 1102 may be integrated with one or more walls 1116 of the portable room 1100. The vent 1102 may be used to remove air from the portable room 1100. The vent 1102 may have a cylindrical shape and may extend outwards from a wall 1116.

The ventilation fan 1120 may directly attach to the vent 1102. Alternatively, the ventilation fan 1120 may attach to the vent 1102 via an air duct 1122. That is, one end of the air duct 1122 attaches to the vent 1102 and another end of the air duct 1122 attaches to the ventilation fan 1120. The vent 1102 or air duct 1122 may wrap around an opening of the ventilation fan 1120. The ventilation fan 1120 may be used to suck air out of the portable room 1100 or blow air into the portable room 1100. The ventilation fan 1120 is not limited to the type of ventilation fan 1120 shown in FIG. 11, other types of ventilation fans 1120 are contemplated.

In another configuration, the vent 1102 is attached to an air conditioner 1130. The air conditioner 1130 may be used to adjust a temperature within the portable room 1100. For example, the air conditioner 1130 may lower the temperature within the portable room 1100. In yet another configuration, the vent 1102 may be attached to a heater to increase the temperature within the portable room 1100. The heater may be the same device as the air conditioner 1130. The heater and/or air conditioner 1130 may attach to the vent 1102 via the air duct 1122.

As shown in FIG. 11, multiple pockets 1104 may be integrated with a roof 1106 of the portable room 1100. Aspects of the present disclosure are not limited to the number of pockets 1104 in FIG. 11, more or fewer pockets 1104 may be used. The roof 1106 refers to the top of the exterior of the portable room 1100, and the ceiling refers to the top of the interior of the portable room 1100. The pockets 1104 may have a uniform size, such as 14"×14". In one configuration, the pockets 1104 receive a filter 1108. The filter 1108 may be any type of material that filters gas, such as air. For example, the filter 1108 may be a mesh air filter, an electrostatic polypropylene air filter, a synthetic air filter, an active carbon air filter, a polyester air filter, or another type of air filter.

When air is blown into the interior of the portable room 1100, via the vent 1102, the air rises and leaves the portable room 1100 via the pockets 1104. The filter 1108 within each pocket 1104 filters particles from the air leaving the portable room 1100. This may be desirable if the air within the portable room 1100 is not clean. For example, if the portable room 1100 is used as a decontamination chamber, the air within the portable room 1100 may be toxic. Therefore, the air should be filtered prior to leaving the portable room 1100, such that the toxic air does not affect the environment surrounding the portable room 1100.

In some cases, the portable room 1100 may be used as a clean room (e.g., crime scene lab). Therefore, the air entering the portable room 1100 should be filtered. In this example, when air is sucked out of the interior, via the vent 1102, new air may enter the interior via pockets 1104. In this configuration, the new air may be filtered via the filters 1108 of the pockets 1104. The pockets 1104 may be referred to as filter pockets.

Aspects of the present disclosure are not limited to using the portable room 1100 as a decontamination chamber or a clean room. The portable room 1100 may have other uses. For example, when camping in a dusty environment, it may be desirable to filter the air entering the portable room 1100. As another example, at a work site, such as a construction site, the portable room 1100 may be used as an office, therefore, it may be desirable to filter the air entering the portable room 1100.

As shown in FIG. 11, the portable room 1100 may include a mesh material 1110 as part of a door 1112 and mesh material 1110 as part of a window 1114. Air may also flow in and out of the interior via the mesh material 1110. In one configuration, a filter 1108 may be integrated with the mesh material 1110. In another configuration, the mesh material 1110 may be covered to prevent air from entering or exiting the interior via the mesh material 1110. The mesh material 1110 may be defined on other sides of the portable room 1100 and is not limited to the sides shown in FIG. 11.

The fabric for the walls 1116 and roof 1106 may be non-porous, such that air may be limited to entering and exiting the interior via the pockets 1104. In one configuration, the portable room 1100 does not include mesh material 1110 on the sides, such that each side is opaque (see FIGS. 18-19).

As shown in FIG. 11, straps 1150 may be attached along a junction of the walls 1116 and roof 1106. The straps 1150 may be used to attach the portable room to a frame, such as a frame of a shelter. In FIG. 11, the attachment point of each strap 1150 to the shelter is illustrated as a circle.

Additionally, side straps 1152 may be attached to a junction of adjacent walls 1116. The side straps 1152 may be used to attach the portable room to a frame, such as a frame or legs of a shelter. The side straps 1152 may be attached to material that extends from a junction of adjacent walls 1116. The portable room 1100 may also include floor straps 1154 attached to a junction of a floor of the portable room and two adjacent walls 1116. The floor straps 1154 may be attached to the ground or a shelter, such as legs of a shelter. The straps 1150, side straps 1152, and floor straps 1154 may be adjustable in length. Each of the straps 1150, 1152, 1154 may include an attaching device, such as a hook, to attach to a structure, such as a shelter leg, a shelter truss link, a shelter bracket, or another type of structure.

The portable room may also include roof straps 1160. In one configuration, the roof straps 1160 include a pair of looping straps and a pair of hook straps. The looping straps may loop around a structure, such as an inner truss link of a shelter. The hook straps may attach to a structure, such as an inner truss link or peak beam bracket.

Figure 12:
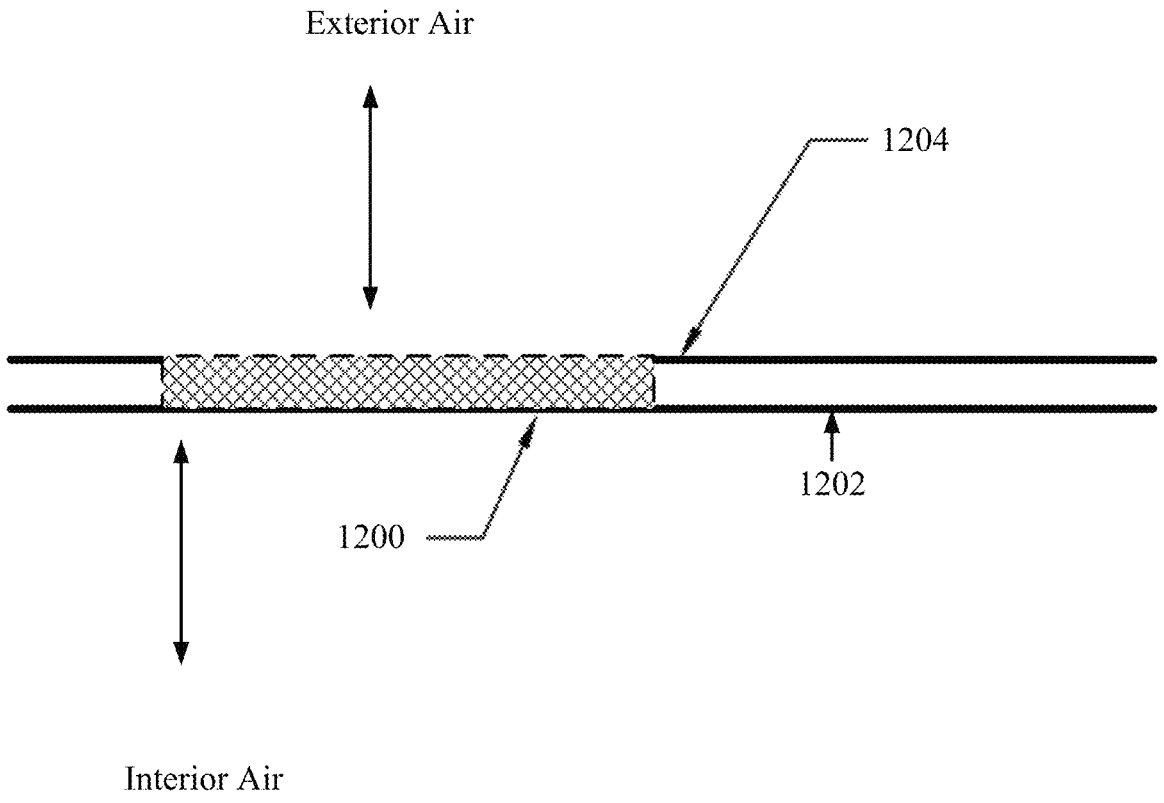
FIGS. 12, 13, and 14 illustrate examples of a filter and a pocket according to aspects of the present disclosure.

FIG. 12 illustrates a cross-sectional view of a pocket 1200 for receiving a filter according to aspects of the present disclosure. As shown in FIG. 12, the pocket may be integrated with a ceiling 1202 and roof 1204 of a portable room. That is, the pocket 1200 is an opening in a space created between the roof 1204 and the ceiling 1202. The pocket may include an opening (not shown in FIG. 12) to insert a filter. The opening may be a zippered opening or another type of opening.

The bottom of the pocket 1200 may be substantially flush with the ceiling 1202. The top of the pocket 1200 may be substantially flush with the roof 1204. Air from the exterior of the portable room may enter the interior of the portable room via the pocket 1200. Alternatively, air from the interior of the portable room may enter the exterior of the portable room via the pocket 1200.

Figure 13:
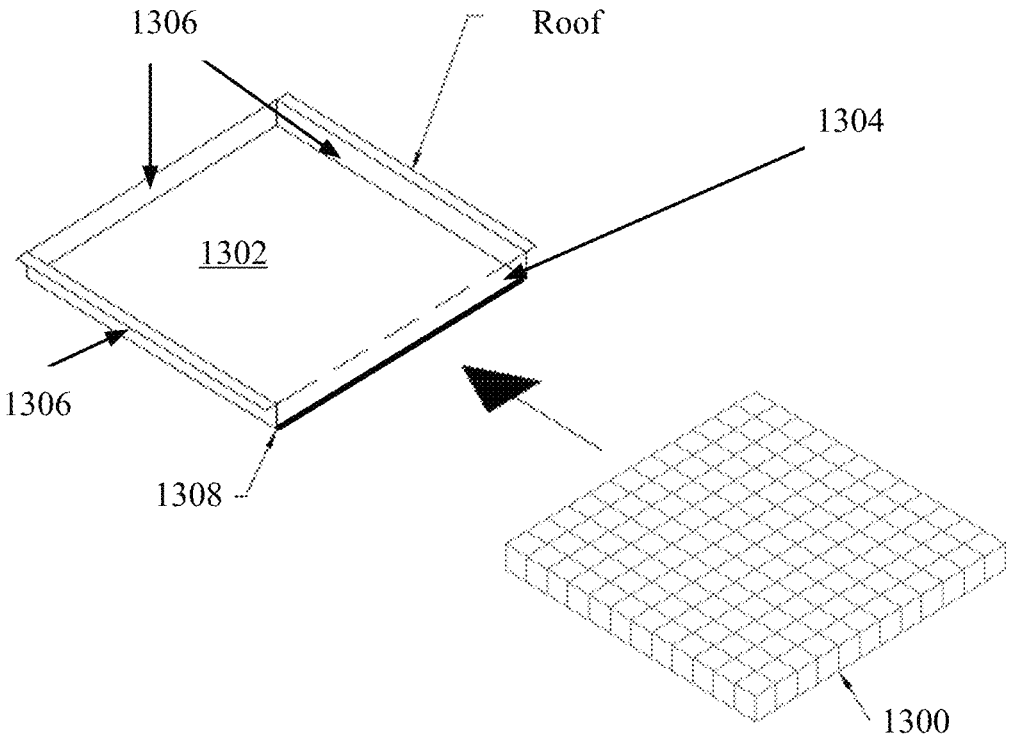

FIG. 13 illustrates an example of inserting a filter 1300 into the pocket 1302 according to aspects of the present disclosure. As shown in FIG. 13, the filter 1300 may be inserted into the pocket 1302 via an opening 1304 of the pocket 1302. That is, the pocket 1302 may include three walls 1306 and the opening 1304. The opening 1304 represents a space between the ceiling and roof to provide access to the pocket 1302.

In one configuration, an opening wall (not shown) covers the opening. A bottom edge 1308 of the opening wall attaches to the ceiling of the portable room. When the bottom edge 1308 is detached from the ceiling, an opening is created for a person to insert the filter 1300 into the pocket 1302. That is, because the ceiling and roof are flexible, the material of the ceiling may be pushed upward to create a temporary opening when the bottom edge 1308 is detached from the ceiling. In another configuration, a bottom portion of the pocket is detachable from the ceiling to allow the filter 1300 to be inserted into the pocket 1302.

The top portion of the pocket may be integrated with the roof. The top portion may be a mesh-type material to allow air to flow through the filter. The bottom of the pocket faces an interior of the portable room and may be integrated with the ceiling. The bottom portion may also be a mesh-type material to allow air to flow through the filter. The top portion and/or bottom portion of the pocket are not limited to mesh-type material. Other materials are also contemplated, such as a clear material to create a sunroof.

Figure 14:
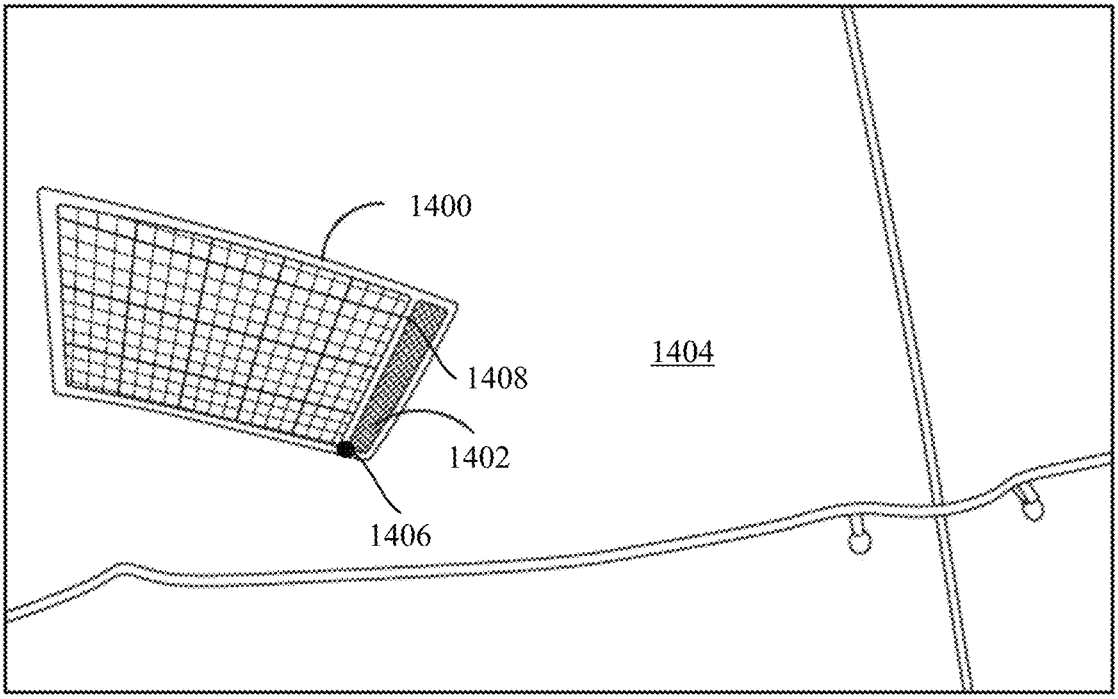

FIG. 14 illustrates an example of a pocket 1400 according to aspects of the present disclosure. In the example of FIG. 14, the pocket 1400 is illustrated from a ceiling-facing view within a portable room. As shown in FIG. 14, a bottom of the pocket 1400 is substantially flush with a ceiling 1404 of a portable room. The pocket 1400 also includes a sealable opening for receiving a filter.

The sealable opening comprises an attaching device 1406 at an edge 1408 of a bottom portion of the pocket 1400. The attaching device 1406 may be a zipper or other type of fastener, such as a hook and loop fastener. The attaching device 1406 is used to attach and detach the edge 1408 of the bottom portion the pocket 1400 to the ceiling 1404, or a portion of the ceiling 1404, of the portable room. The portion of the ceiling 1404 may be a lip 1402 that extends beyond one of the walls of the pocket 1400.

When the attaching device 1406 detaches the edge 1408 of the bottom portion from the ceiling 1404, an opening is created for a person to insert a filter into the pocket 1400. That is, because the ceiling 1404 and roof are flexible, the material of the ceiling 1404 may be pushed upward to create a temporary opening when the attaching device 1406 detaches the edge of the bottom portion from the ceiling 1404.

Aspects of the present disclosure are not limited to inserting a filter into the pocket 1400. The pocket 1400 may receive other types of material or items. For example, the pocket 1400 may receive transparent material to provide a sunroof to the portable room. As another example, fans or heaters may be inserted into the pockets. The fans or heaters may be integrated into a housing that fits the dimensions of the pockets 1400. Power may be provided to the fans and heaters via a battery or external power source.

Figure 15:
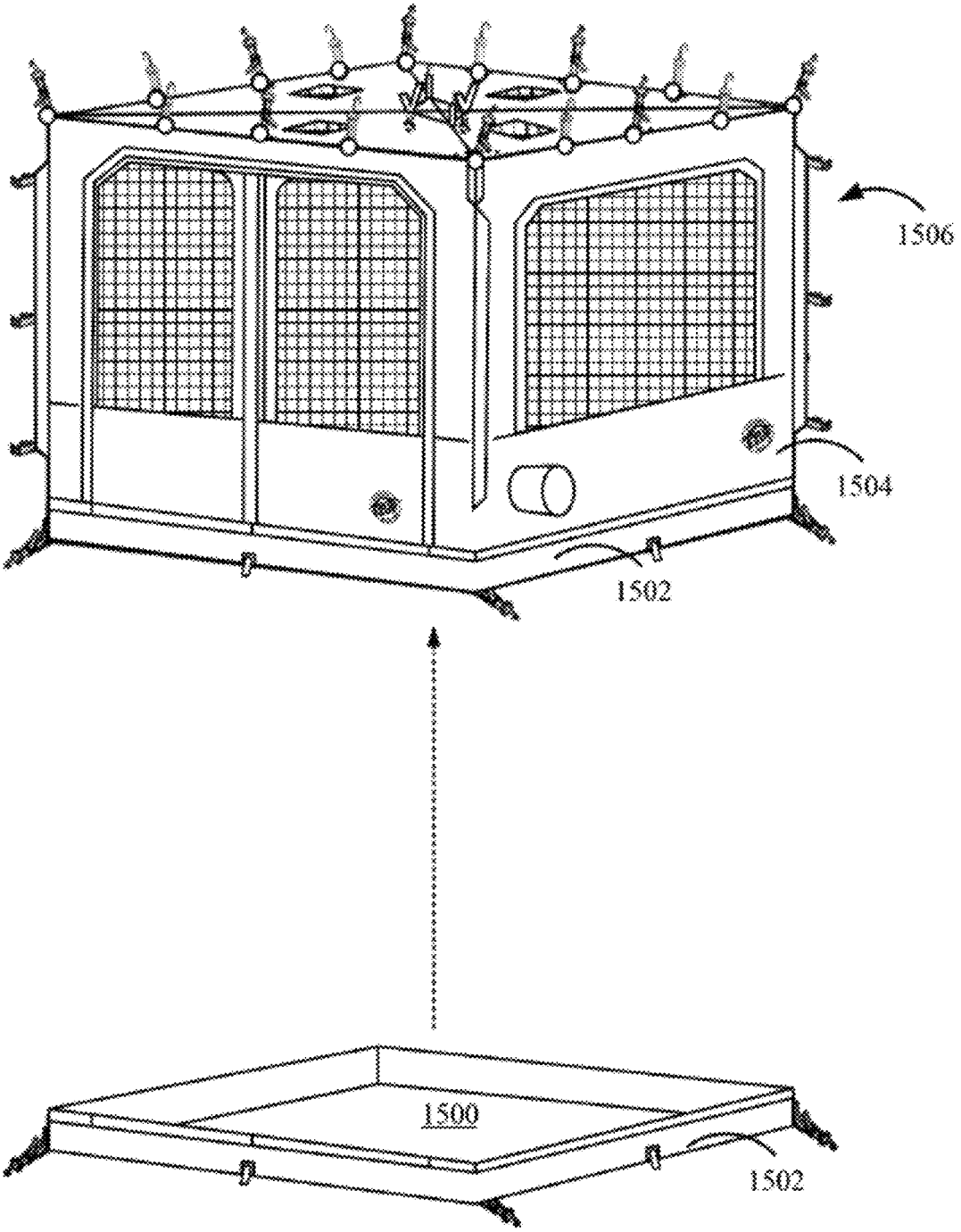
FIG. 15 illustrates an example of a portable shelter with a detachable floor according to aspects of the present disclosure.

In one configuration, a floor of the portable room is removable. The floor may include walls that are attached to the bottom of the walls of the portable room. For example, the floor walls may attach to walls of the portable room via zippers. The floor may be removed for cleaning, disposal, or other needs. FIG. 15 illustrates an example of a removable floor 1500 according to aspects of the present disclosure. As shown in FIG. 15, the removable floor 1500 includes four walls 1502. Each wall 1502 of the removable floor 1500 may attach to a wall 1504 of a portable room 1506. The walls 1502, 1504 may attach via a connector, such as a zipper. The removable floor 1500 may be made of different types of material. As one example, the removable floor 1500 is polyvinyl chloride (PVC) tarpaulin.

Figure 16:
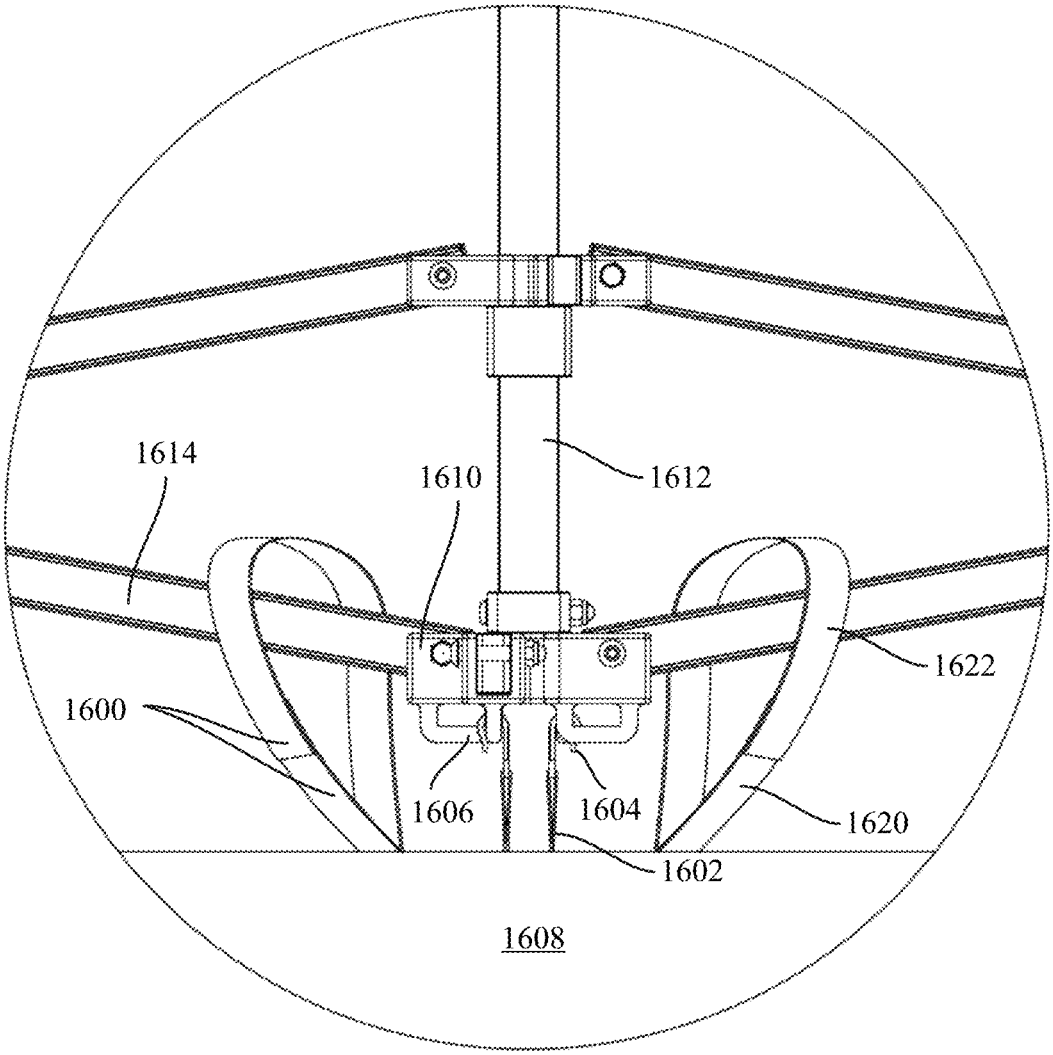
FIG. 16 illustrates an example of roof straps according to aspects of the present disclosure.

FIG. 16 illustrates an example of roof straps 1600, 1602 of a portable shelter according to aspects of the present disclosure. As shown in FIG. 16, a pair of loop straps 1600 and a pair of hook straps 1602 are attached to a roof 1608 of a portable shelter (see FIG. 11). The loop straps 1600 and hook straps 1602 are not limited to two of each type of strap 1600, 1602, more or fewer straps 1600, 1602 may be attached to the roof 1608. The straps 1600, 1602 secure the portable room to a structure, such as a shelter. The straps 1600, 1602 may be elastic so that the portable room does not topple in windy conditions.

The loop strap 1600 includes a short strap 1620 and a long strap 1622, which collectively form the loop strap 1600. An end of the short strap 1620 attaches to an end of the long strap 1622 to form a loop. The ends may attach via a connection, such as a hook and loop fastening system. As shown in FIG. 16, the loop strap 1600 may loop around a truss link 1614. The truss link 1614 may be an inner truss link, such as the inner truss link 554 of FIG. 5A, pivotally attached to a center bracket 1610 that is attached to a peak beam 1612.

In one configuration, a hook 1604 is attached to an end of the hook strap 1602 (see FIG. 3). The hook 1604 may attach to a handle 1606 of the center bracket 1610. Additionally, or alternatively, one or more handles 1606 of the hook strap 1602 may be attached a truss link 1614 or other structure.

Figure 17:
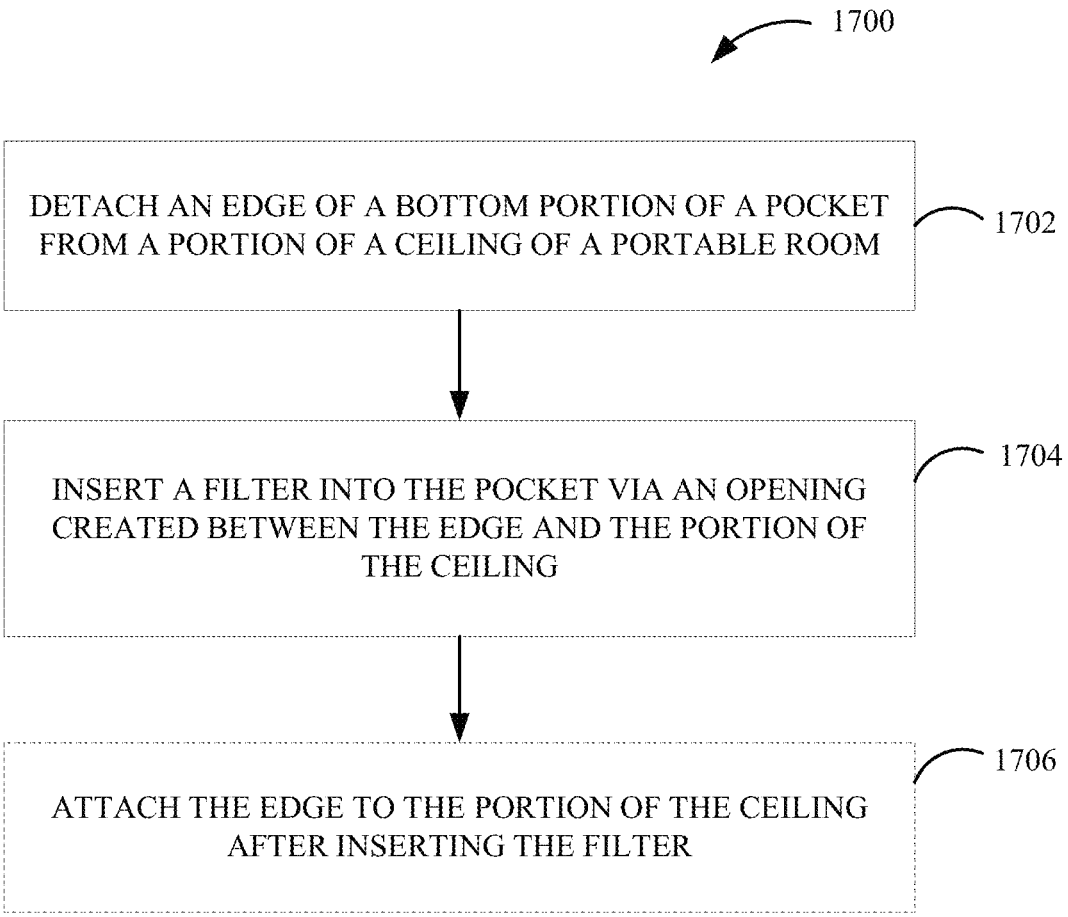
FIG. 17 illustrates a flow diagram for a method according to aspects of the present disclosure.

FIG. 17 illustrates a flow diagram 1700 for a method according to aspects of the present disclosure. As shown in FIG. 17, at block 1702 an edge of a bottom portion of a pocket is detached from a portion of a ceiling of a portable room. The pocket may be integrated into a space of the ceiling and roof of the portable room. The pocket includes a top portion attached to a roof of the portable room, a bottom portion attached to the ceiling, and a multiple walls attached to the roof and the ceiling. In one configuration, the upper portion and the lower portion are composed of a mesh-material.

At block 1704, a filter is inserted into the pocket via an opening created between the edge and the portion of the ceiling. The filter may be an air filter. For example, the filter may filter air entering or leaving the portable room. In an optional configuration, at block 1706, the edge is attached to the portion of the ceiling after inserting the filter.

As discussed, portable rooms may be used for camping and outdoor activities. Alternatively, a portable room may be used for other tasks, such as painting, or other industrial tasks. A portable room used for an industrial task may be referred to as a containment room. The containment room may prevent elements that are external to the room from entering the room, thus providing a clean internal environment. Additionally, it is desirable to prevent internal elements, such as paint or toxic air, from leaving the containment room. Aspects of the present disclosure are not limited from using the containment room for industrial tasks. The containment room may be used for other purposes, such as a changing room.

Figure 18:
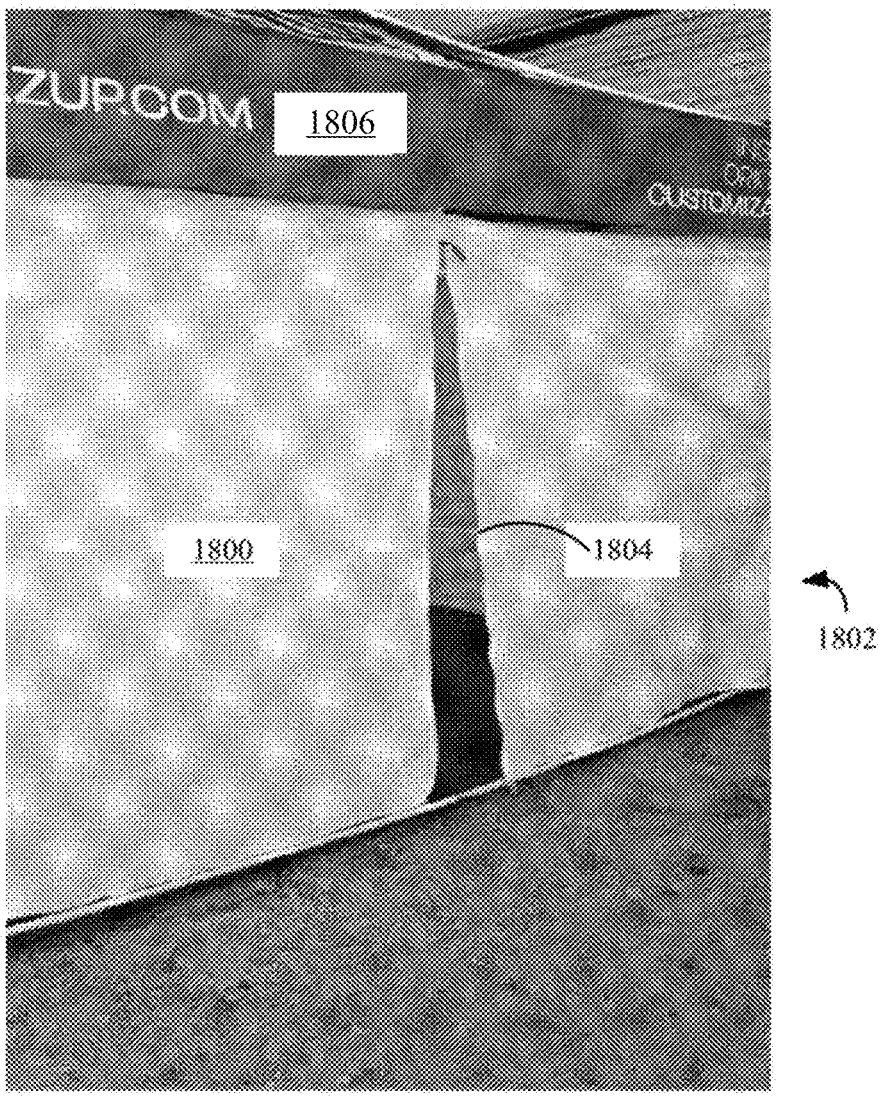
FIGS. 18 and 19 illustrate examples of portable containment rooms according to aspects of the present disclosure.

FIG. 18 illustrates an example of a containment room 1802 according to aspects of the present disclosure. As shown in FIG. 18, the containment room includes a wall 1800 with a zippered opening 1804. When opened, the zippered opening 1804 provides access to the interior of the containment room 1802. As shown in FIG. 18, the containment room may be attached to a frame with a roof structure 1806.

FIG. 18 illustrates one wall 1800. The containment room 1802 includes four walls 1800. In one configuration, the zippered opening 1804 is limited to one of the four walls 1800. That is, the zippered opening 1804 may be limited to one side of the containment room 1802. According to aspects of the present disclosure, the walls 1800 are opaque and non-porous. That is, other than the zippered opening 1804, the walls 1800 do not include other types of openings, such as windows. The walls 1800 prevent elements that are external to the room from entering the room. Additionally, the walls 1800 prevent internal elements, such as paint or toxic air, from leaving the containment room.

Figure 19:
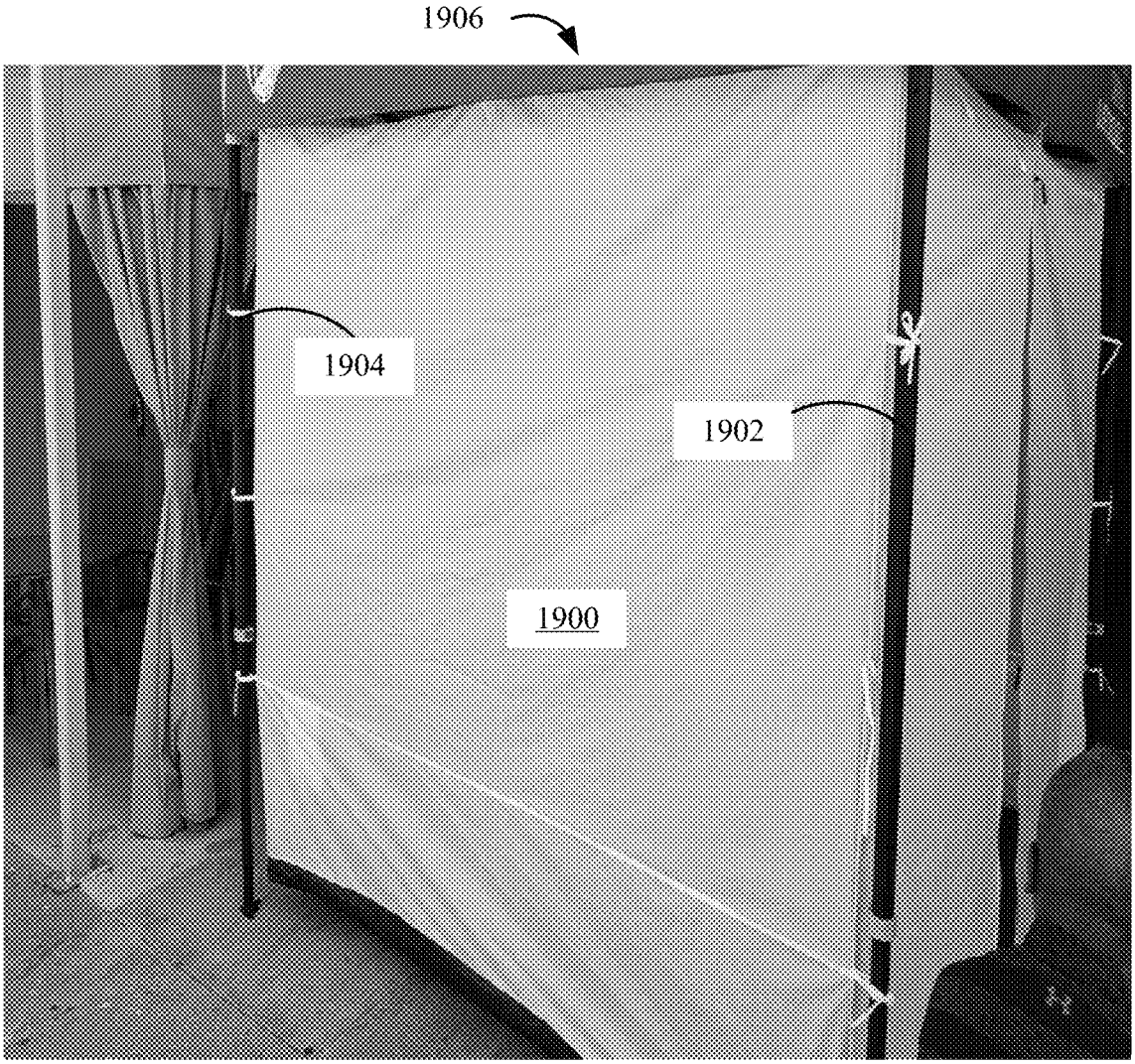

FIG. 19 illustrates an example of a containment room 1906 according to aspects of the present disclosure. As shown in FIG. 19, the containment room 1906 may be attached to legs 1902 of a frame. Specifically, straps 1904 may be used to tie the containment room 1906 to the legs 1902. The straps 1904 may be tied or include fasteners (e.g., hooks). As another example, the straps 1904 may include loops and hooks (e.g., VELCRO™) for fastening around the legs 1902. In one configuration, the walls 1900 are opaque and non-porous.

The roof of the containment room may include straps, such as loop straps and hook straps for attachment to the shelter (see FIG. 16). The containment room may also receive filters, such as air filters (see FIG. 11). The ends may attach via a connection, such as a hook and loop fastening system.

As used herein, a phrase referring to "at least one of" a list of items refers to any combination of those items, including single members. As an example, "at least one of: a, b, or c" is intended to cover: a, b, c, a-b, a-c, b-c, and a-b-c.

The methods disclosed herein comprise one or more steps or actions for achieving the described method. The method steps and/or actions may be interchanged with one another without departing from the scope of the claims. In other words, unless a specific order of steps or actions is specified, the order and/or use of specific steps and/or actions may be modified without departing from the scope of the claims.

It is to be understood that the claims are not limited to the precise configuration and components illustrated above. Various modifications, changes, and variations may be made in the arrangement, operation, and details of the methods and apparatus described above without departing from the scope of the claims.

What is claimed is:

1. A containment room, comprising:

a plurality of opaque sides, one of the plurality of opaque sides comprising an opening for providing access to an interior of the containment room;

a roof attached to the plurality of opaque sides; and a plurality of pockets integrated with the roof, each pocket configured for receiving an insert, and each pocket comprising a top portion attached to the roof, a bottom portion attached to a ceiling of the containment room, and a plurality of walls defined between the roof and the ceiling.

2. The containment room of claim 1, in which each pocket comprises a pocket opening.

3. The containment room of claim 2, in which the insert is a filter that is inserted into a pocket via the pocket opening.

4. The containment room of claim 3, in which the pocket opening is defined within an interior portion of the containment room.

5. The containment room of claim 1, further comprising a vent defined on one of the plurality of opaque sides.

6. The containment room of claim 5, in which air is blown into the containment room or out of the containment room via the vent.

7. The containment room of claim 1, in which an upper portion and a lower portion of the pocket are a mesh-material.

8. The containment room of claim 1, further comprising a detachable floor.

9. The containment room of claim 1, in which each opaque side is non-porous.

10. The containment room of claim 1, in which each opaque side is attached to a frame comprising a plurality of legs for supporting a roof structure comprising an inner truss and an outer truss.

11. A containment room in combination with a frame, the frame comprising:

a plurality of legs for supporting a roof structure comprising an inner truss and an outer truss; and the containment room comprising:

a plurality of opaque sides, one of the plurality of opaque sides comprising an opening for providing access to an interior of the containment room, at least one side attached to one of the plurality of legs;

a roof attached to the plurality of opaque sides; and a plurality of pockets integrated with the roof, each pocket configured for receiving an insert, and each pocket comprising a top portion attached to the roof, a bottom portion attached to a ceiling of the containment room, and a plurality of walls defined between the roof and the ceiling.

12. The combination of claim 11, in which an edge of the bottom portion is detachable from the ceiling.

13. The combination of claim 11, in which:

the inner truss comprises a plurality of peak beams, and the containment room comprises a flexible strap attached to the roof and at least one peak beam of the plurality of peak beams.

14. The combination of claim 11, in which each opaque side is non-porous.

15. The combination of claim 11, further comprising a vent defined on one of the plurality of opaque sides.

16. The combination of claim 11, in which the insert is a filter that is inserted into a pocket via a pocket opening.

* * * * *